US009254621B2

(12) United States Patent
Takahashi et al.

(10) Patent No.: US 9,254,621 B2
(45) Date of Patent: Feb. 9, 2016

(54) METHOD FOR ATTACHING CRIMPING MEMBERS, SHEET BINDING DEVICE, AND IMAGE FORMING APPARATUS

(71) Applicants: Wataru Takahashi, Tokyo (JP); Nobuyoshi Suzuki, Tokyo (JP); Shingo Matsushita, Tokyo (JP); Katsuhiro Kosuge, Kanagawa (JP); Yuusuke Shibasaki, Kanagawa (JP); Ryuji Yoshida, Kanagawa (JP); Takashi Saito, Kanagawa (JP); Akihiro Musha, Kanagawa (JP); Takuya Morinaga, Tokyo (JP); Ikuhisa Okamoto, Kanagawa (JP)

(72) Inventors: Wataru Takahashi, Tokyo (JP); Nobuyoshi Suzuki, Tokyo (JP); Shingo Matsushita, Tokyo (JP); Katsuhiro Kosuge, Kanagawa (JP); Yuusuke Shibasaki, Kanagawa (JP); Ryuji Yoshida, Kanagawa (JP); Takashi Saito, Kanagawa (JP); Akihiro Musha, Kanagawa (JP); Takuya Morinaga, Tokyo (JP); Ikuhisa Okamoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/331,590

(22) Filed: Jul. 15, 2014

(65) Prior Publication Data

US 2015/0030414 A1 Jan. 29, 2015

(30) Foreign Application Priority Data

Jul. 25, 2013 (JP) ..... 2013-155015

(51) Int. Cl.

| | |
|---|---|
| ***B31F 5/02*** | (2006.01) |
| ***B42C 13/00*** | (2006.01) |
| ***B42C 5/02*** | (2006.01) |

(Continued)

(52) U.S. Cl.

CPC ... *B31F 5/02* (2013.01); *B42C 5/02* (2013.01); *B42C 13/00* (2013.01); *B65H 37/04* (2013.01); *G03G 15/60* (2013.01); *G03G 15/6541* (2013.01); *B31F 2201/00* (2013.01); *B65H 2301/5126* (2013.01); *B65H 2301/51616* (2013.01); *G03G 21/1609* (2013.01); *G03G 2215/00848* (2013.01); *G03G 2215/00852* (2013.01); *G03G 2221/1696* (2013.01)

(58) Field of Classification Search

CPC ..... B31F 5/02; B31F 2201/00; G03G 2215/00852; B65H 2301/51616

USPC ..... 270/58.07, 58.08

See application file for complete search history.

(56) References Cited

U.S. PATENT DOCUMENTS

| | | | | |
|---|---|---|---|---|
| 3,451,082 | A * | 6/1969 | Sarring | 412/5 |
| 7,938,388 | B2 | 5/2011 | Fujii et al. | |

(Continued)

FOREIGN PATENT DOCUMENTS

| | | | |
|---|---|---|---|
| EP | 2053004 | A1 | 4/2009 |
| JP | 2011201670 | A | 10/2011 |
| WO | WO2009/110298 | A1 | 9/2009 |

OTHER PUBLICATIONS

Extended European Search Report dated Oct. 20, 2014.

(Continued)

*Primary Examiner* — Leslie A Nicholson, III

(74) *Attorney, Agent, or Firm* — Harness, Dickey & Pierce, P.L.C.

(57) ABSTRACT

The present invention is concerning a method for attaching a pair of crimping members in a sheet binding device that binds a sheet bundle by engagement of the pair of crimping members, wherein at least one of the crimping members is attached to a member to which the one of the crimping members is to be attached in a state where the pair of crimping members is in engagement.

7 Claims, 20 Drawing Sheets

(51) Int. Cl.

| | |
|---|---|
| ***B65H 37/04*** | (2006.01) |
| ***G03G 15/00*** | (2006.01) |
| *G03G 21/16* | (2006.01) |

(56) References Cited

U.S. PATENT DOCUMENTS

| | | | | |
|---|---|---|---|---|
| 2010/0202814 | A1 | 8/2010 | Nakamura | |
| 2011/0184889 | A1 | 7/2011 | Tokita et al. | |
| 2011/0220557 | A1 | 9/2011 | Sasaki et al. | |
| 2011/0222945 | A1* | 9/2011 | Sato | 399/408 |
| 2012/0083400 | A1 | 4/2012 | Shibasaki et al. | |
| 2012/0131885 | A1 | 5/2012 | Matsushita et al. | |
| 2012/0148372 | A1* | 6/2012 | Mori | 412/33 |
| 2012/0153556 | A1 | 6/2012 | Sugiyama et al. | |
| 2012/0229551 | A1 | 9/2012 | Watanabe et al. | |
| 2012/0282004 | A1 | 11/2012 | Furuhashi et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0154178 | A1 | 6/2013 | Suzuki et al. | |
| 2013/0215481 | A1 | 8/2013 | Hayasaka et al. | |
| 2013/0242359 | A1 | 9/2013 | Heishi et al. | |
| 2013/0264762 | A1 | 10/2013 | Matsushita et al. | |
| 2013/0270762 | A1 | 10/2013 | Saito et al. | |
| 2013/0300050 | A1 | 11/2013 | Suzuki et al. | |
| 2013/0320611 | A1 | 12/2013 | Kubo et al. | |

OTHER PUBLICATIONS

U.S. Appl. No. 14/028,848, filed Sep. 17, 2013.

U.S. Appl. No. 14/072,956, filed Nov. 6, 2013.

* cited by examiner (b)

(a)

(a)

(b)

(a)

(b)

METHOD FOR ATTACHING CRIMPING MEMBERS, SHEET BINDING DEVICE, AND IMAGE FORMING APPARATUS

CROSS-REFERENCE TO RELATED APPLICATIONS

The present application claims priority to and incorporates by reference the entire contents of Japanese Patent Application No. 2013-155015 filed in Japan on Jul. 25, 2013.

BACKGROUND OF THE INVENTION

1. Field of the Invention

The present invention relates to a method for attaching crimping members, a sheet binding device, and an image forming apparatus.

2. Description of the Related Art

Conventionally, there are known a sheet binding device for binding a bundle of sheets on which images have been formed and an image forming apparatus equipped with the sheet binding device.

In International Publication Pamphlet No. WO 2009/110298, there is described a crimping sheet binding device that binds a bundle of sheets by crimping the sheets without using a metal staple in such a way that the sheet binding device strongly engage crimping teeth, which are a pair of jagged crimping members, thereby entwining fibers of the sheets. The bundle of sheets is bound by crimping without using a metal staple; therefore, when the bundle of sheets is disposed or put through a shredder, it is possible to avoid the trouble of having to remove the metal staple from the bundle of sheets.

In a conventional crimping sheet binding device, one of a pair of crimping members is attached on a fixed member, and the other crimping member is attached on a movable member that can move close to and away from the crimping member attached on the fixed member.

However, due to attachment errors of the crimping members and the accuracies of the members attached to the crimping members, etc., the crimping members may be attached in positions deviated from their original engagement position. If the crimping members are attached in positions deviated from the original engagement positions in this way, the crimping members have a strongly-engaged portion and a weakly-engaged portion, thereby fail to apply a stable binding force.

In view of the above problem, there is a need to provide a method for attaching crimping members, sheet binding device, and image forming apparatus capable of achieving a stable binding force.

SUMMARY OF THE INVENTION

It is an object of the present invention to at least partially solve the problems in the conventional technology.

According to the present invention, there is provided a method for attaching a pair of crimping members in a sheet binding device that binds a sheet bundle by engagement of the pair of crimping members, wherein at least one of the crimping members is attached to a member to which the one of the crimping members is to be attached in a state where the pair of crimping members is in engagement.

The present invention also provides a sheet binding device that binds a sheet bundle by engagement of a pair of crimping members, wherein the pair of crimping members is attached by the above-mentioned method.

The present invention also provides a sheet binding device that binds a sheet bundle by engagement of a pair of crimping members, wherein one of the crimping members is attached by inserting a fastener member into a through-hole formed on a member to which the one of the crimping members is to be attached, the through-hole being parallel to a direction of binding the sheet bundle, and a gap between the through-hole and the fastener member is larger than a position error of the member to which the one of the crimping members is to be attached with respect to a member to which the other crimping member is to be attached.

The present invention also provides an image forming apparatus that forms an image on a sheet, comprising one of the above-mentioned sheet binding devices as a binding processing unit for binding sheets on which images have been formed.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 20(*b*) is a diagram illustrating a lower toothed die of the modified toothed die;

DETAILED DESCRIPTION OF THE PREFERRED EMBODIMENTS

An exemplary embodiment of the present invention will be explained below with reference to accompanying drawings.

Figure 1:
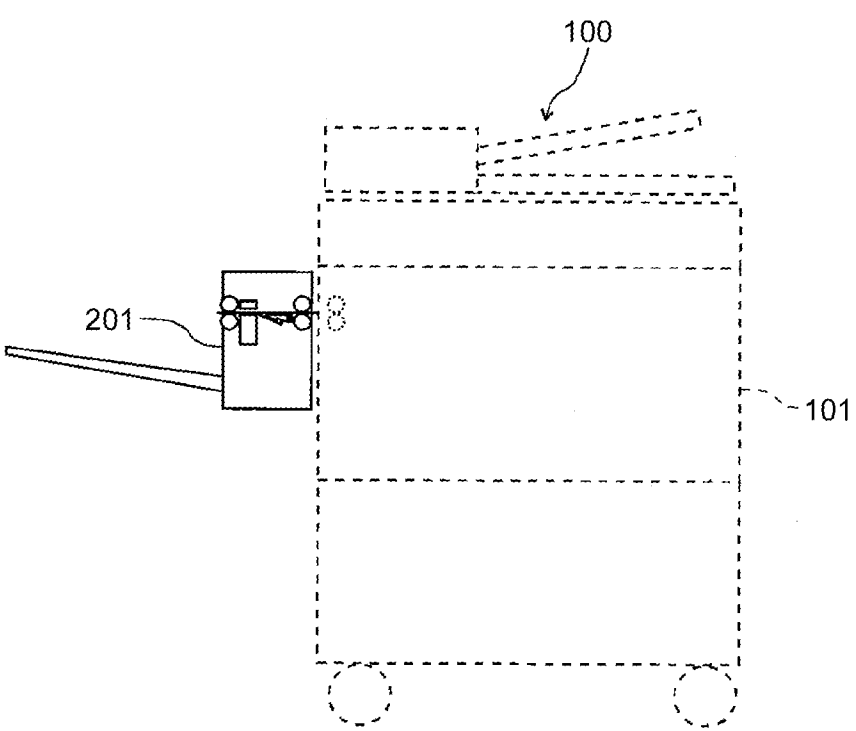
FIGS. 1(*a*) and 1(*b*) are schematic configuration diagrams illustrating examples of an entire configuration of an image forming apparatus according to an embodiment of the present invention.
Figure 1:
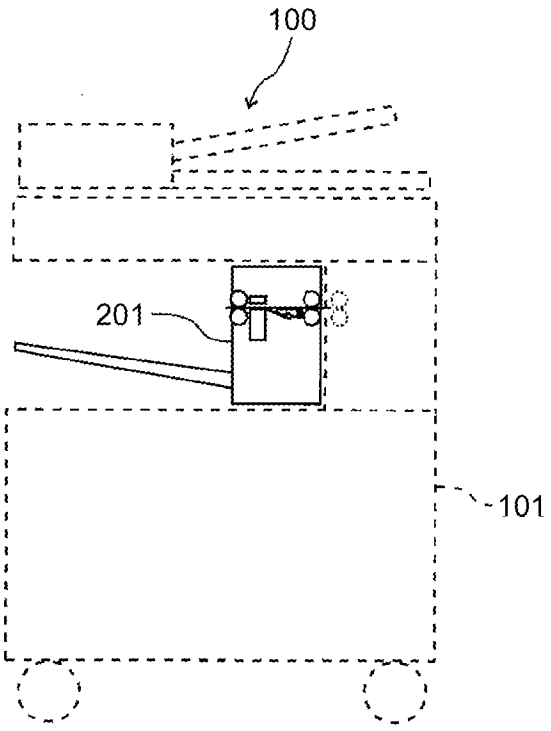

FIGS. 1(*a*) and 1(*b*) are schematic configuration diagrams illustrating examples of an entire configuration of an image forming apparatus according to an embodiment of the present invention. FIG. 1(*a*) shows an example of an image forming apparatus 100 configured that a sheet post-processing apparatus 201 as a sheet binding device is incorporated in an image forming apparatus main body 101 as an image forming means that forms an image on a sheet on the basis of an input image. FIG. 1(*b*) shows another example of the image forming apparatus 100 configured that the sheet post-processing apparatus 201 is connected to the image forming apparatus main body 101.

Incidentally, the image forming apparatus 100 according to the present embodiment is an electrophotographic image forming apparatus that forms an image formed of toner images on a sheet; however, the present invention can be applied to other types of image forming apparatuses, such as an ink-jet image forming apparatus. Furthermore, in the present embodiment, there is described an image forming apparatus composed of a combination of the image forming apparatus main body 101 and the sheet post-processing apparatus 201; however, the present invention can be applied to an image forming apparatus including the sheet post-processing apparatus 201 built into the image forming apparatus main body 101.

Moreover, the present invention can be also applied to a case where the sheet post-processing apparatus 201 is configured to be independent of the image forming apparatus main body 101. In this case, a cassette or tray in which sheets to be bound are set and a tray (for example tray 222 shown in FIG. 2) onto which a bundle of sheets is output, etc. can be attached in the sheet post-processing apparatus.

Figure 2:
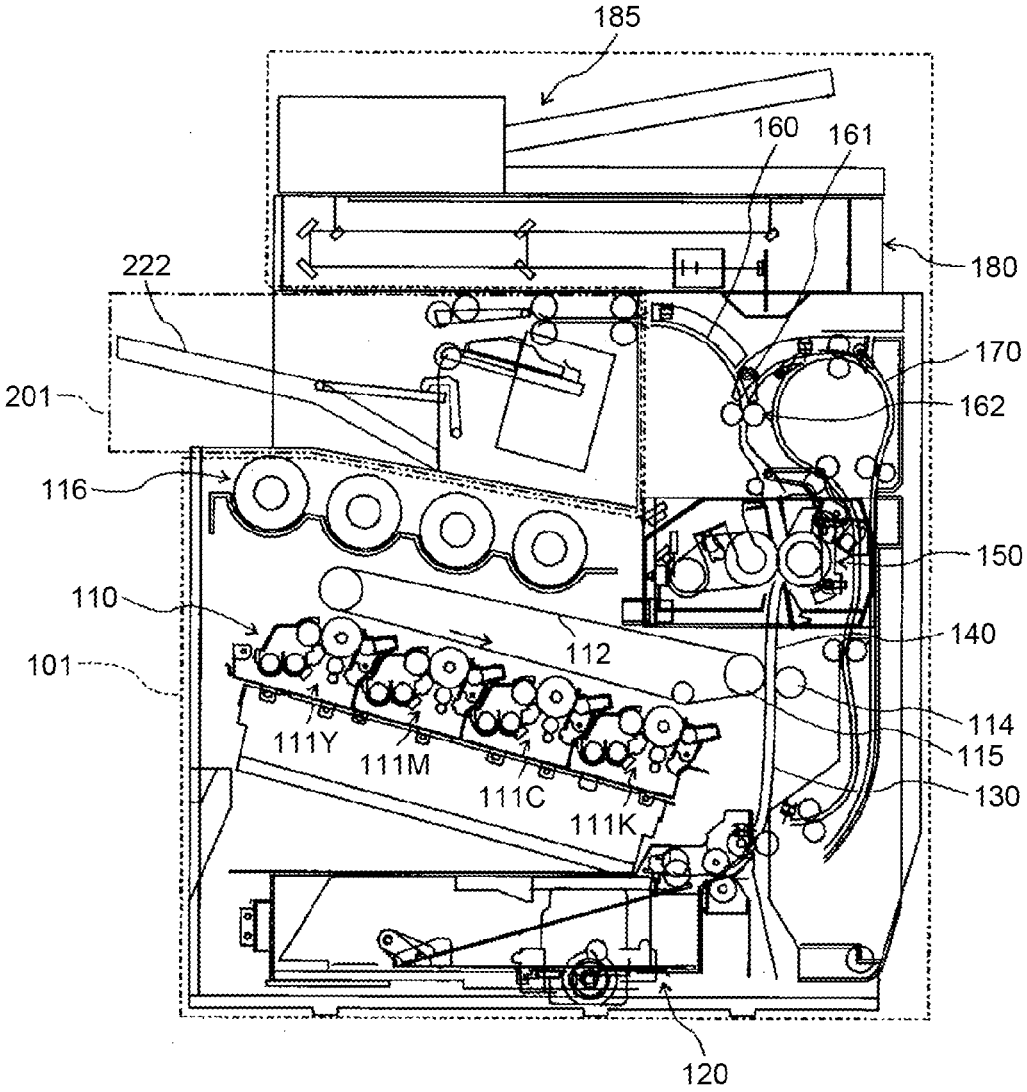
FIG. 2 is a schematic configuration diagram illustrating an example of a configuration of the image forming apparatus according to the present embodiment.

FIG. 2 is a schematic configuration diagram illustrating an example of a configuration of the image forming apparatus 100 according to the present embodiment.

In FIG. 2, the image forming apparatus 100 is an indirect transfer tandem-type color image forming apparatus using an intermediate transfer member. An imaging unit 110 as a toner-image forming means is placed roughly in the center of the image forming apparatus main body 101. The imaging unit 110 includes four imaging stations 111Y, 111M, 111C, and 111K for forming yellow (Y), magenta (K), cyan (C), and black (K) toner images, respectively; the imaging stations 111Y, 111M, 111C, and 111K (hereinafter, may also be referred to collectively as "the imaging station(s) 111") are arranged to be aligned in a given direction.

The image forming apparatus main body 101 includes a sheet feed tray 120 being multiple sheet feeders as a recording-medium supplying means below the imaging unit 110. Furthermore, the image forming apparatus main body 101 includes a sheet feed conveyance path (a vertical conveyance path) 130 through which a sheet as a recording medium picked up from the sheet feed tray 120 is conveyed to a secondary transfer unit 140 and a fixing unit 150. Moreover, the image forming apparatus main body 101 includes a branch sheet discharge path 160 through which a sheet on which an image (a toner image) has been fixed is conveyed to the side of the sheet post-processing apparatus 201 and a duplex conveyance path 170 in which a sheet that an image has been formed on a first surface (the front side) thereof is reversed to form an image on a second surface (the back side) thereof.

Furthermore, the image forming apparatus main body 101 includes a scanner unit 180 as an image reading means and an automatic document feeder (ADF) 185 as an original supplying means. A user sets an original whose image is to be read on a platen glass of the scanner unit 180, and the scanner unit 180 reads an image of the original and converts the image into an electrical signal. And, a user sets one or more originals whose images are to be read by the scanner unit 180 in the ADF 185, and the ADF 185 sequentially feeds the originals onto the platen glass of the scanner unit 180.

The imaging unit 110 includes photosensitive drums as YMCK image carriers of the imaging stations 111. Around each photosensitive drum, a charging unit as a charging means, a developing unit as a developing means, a primary transfer unit, a cleaning unit, and an electrostatic eliminating unit as an electrostatic eliminating means are arranged along an outer periphery of the photosensitive drum. Furthermore, the imaging unit 110 includes an optical writing unit (not shown) as an exposure means and an intermediate transfer belt 112 as an intermediate transfer member. The optical writing unit is placed on the lower side of the imaging stations 111, and forms YMCK electrostatic latent images on the photosensitive drums by exposing the photosensitive drums to lights on the basis of image data generated from a result of reading by the scanner unit 180, respectively. The intermediate transfer belt 112 is placed on the upper side of the imaging stations 111, and images (toner images) formed on the photosensitive drums are sequentially transferred onto the intermediate transfer belt 112 by the primary transfer units in a manner superimposed on top of one another.

The intermediate transfer belt 112 is rotatably supported by multiple support rollers. Out of the multiple support rollers, a support roller 114 is opposed to a secondary transfer roller 115 in the secondary transfer unit 140 through the intermediate transfer belt 112. In this secondary transfer unit 140, the image (the superimposed toner images) on the intermediate transfer belt 112 is secondarily transferred onto a sheet conveyed from the sheet feed tray 120. Replaceable toner containers 116 are placed above the intermediate transfer belt 112.

Incidentally, an image forming process of the image forming apparatus configured as described above (the indirect transfer tandem-type color image forming apparatus) is a publicly-known process, and is not directly related to the gist of the present invention, so detailed description of the image forming process is omitted.

After the image has been fixed on the sheet by the fixing unit 150, the sheet is conveyed by a conveyance roller 162, and a conveying direction of the sheet is switched by a conveyance-path switching member 161. As a result, the sheet is conveyed to the branch sheet discharge path 160 or the duplex conveyance path 170.

The sheet post-processing apparatus (sheet binding device) 201 according to the present embodiment has a conveyance-path binding mechanism as a sheet binding means for binding a bundle of multiple sheets as post-processing on multiple sheets including sheets on which images have been formed. This conveyance-path binding mechanism includes a mechanism for stacking sheets on top of one another in correct alignment on a sheet conveyance path and a binding tool as a binding means for binding the sheets stacked on top of one another.

Figure 3:
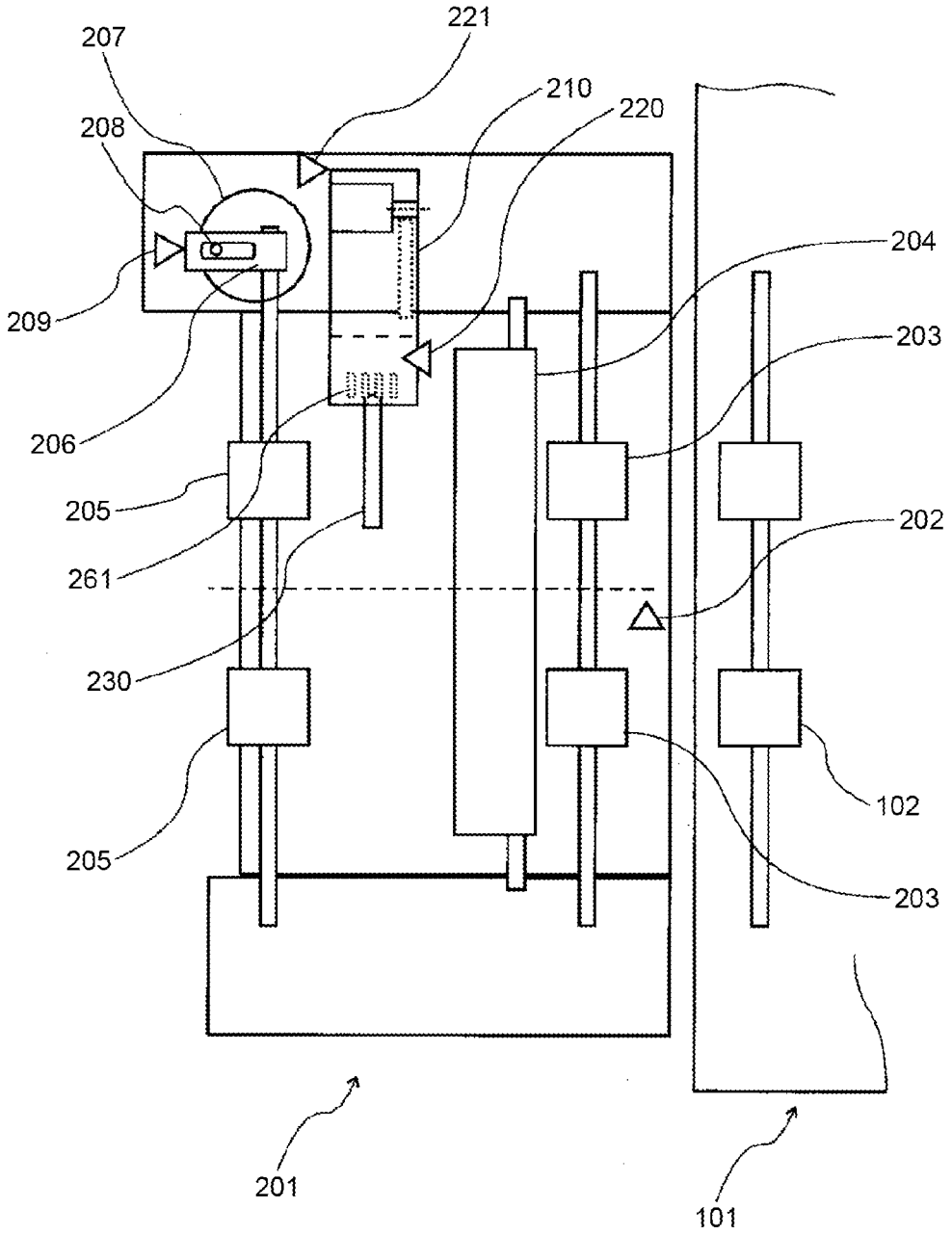
FIG. 3 is a plan view illustrating an example of a configuration of a sheet post-processing apparatus in the image forming apparatus according to the present embodiment.
Figure 4:
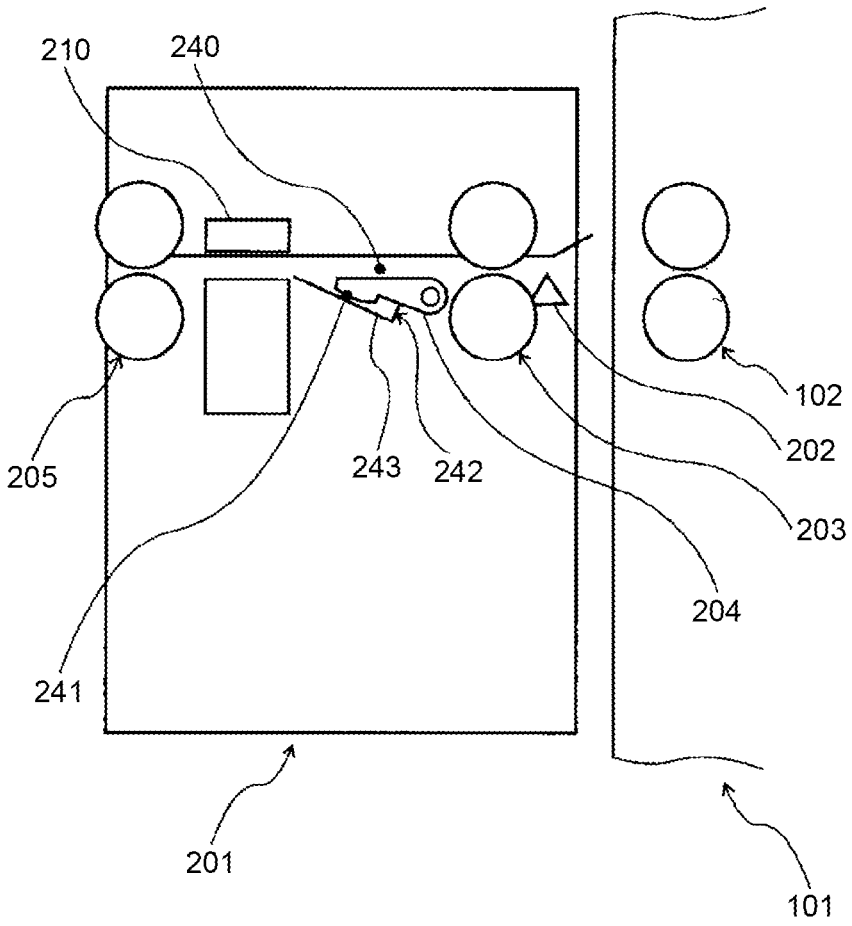
FIG. 4 is a front view of the sheet post-processing apparatus.

FIGS. 3 and 4 are a plan view and front view showing an example of a configuration of the sheet post-processing apparatus 201 having the conveyance-path binding mechanism included in the image forming apparatus 100 according to the present embodiment, respectively.

The sheet post-processing apparatus 201 includes an inlet sensor 202, a pair of inlet rollers 203, a bifurcating claw (a switching claw) 204, a pair of sheet discharge rollers 205, a shift link 206, a shift cam 207, a shift cam stud 208, a shift home position sensor 209, and a binding tool 210.

The inlet sensor 202 detects the leading and trailing ends of a sheet brought into the sheet post-processing apparatus 201 through a sheet discharge roller 102 of the image forming apparatus main body 101 and the presence or absence of the sheet.

The pair of inlet rollers 203 is placed at an inlet of the sheet post-processing apparatus 201, and has a function of bringing a sheet into the sheet post-processing apparatus 201. By using a roller nip of the pair of inlet rollers 203, skew of the sheet can be corrected by butting the sheet against the roller nip. The pair of inlet rollers 203 is driven by a controllable drive source (not shown). This drive source is controlled by a control means (not shown), thereby the rotation and stoppage of the pair of inlet rollers 203 driven by the drive source and a conveyance amount of the sheet conveyed by the pair of inlet rollers 203 are controlled. Incidentally, the control means can be placed in the image forming apparatus main body 101.

The bifurcating claw 204 is a turnable claw for switching a conveyance path provided to lead the trailing end of a sheet to a branch path 241. Furthermore, the bifurcating claw 204 is configured to be able to press a sheet against a branch-path conveyance surface, and can hold a sheet by pressing the sheet.

The pair of sheet discharge rollers 205 is placed at an outlet of the sheet post-processing apparatus 201, and has a function of conveying, shifting, and discharging a sheet to the outside of the sheet post-processing apparatus 201. The pair of sheet discharge rollers 205 is driven by a controllable drive source (not shown). This drive source is controlled by a control means to be described later, thereby the rotation and stoppage of the pair of sheet discharge rollers 205 driven by the drive source and a conveyance amount of the sheet conveyed by the pair of sheet discharge rollers 205 are controlled.

A conveying means for conveying a sheet within the sheet post-processing apparatus 201 according to the present embodiment is composed of, for example, the pair of inlet rollers 203, the pair of sheet discharge rollers 205, and the drive sources for driving these, etc.

The shift link 206 is attached to an end of a shaft of the sheet discharge roller 205, and is a region subjected to a moving force due to shifting.

The shift cam 207 includes the shift cam stud 208, and is a disk-shaped rotating part. By the rotation of this part, the sheet discharge roller 205 joined to a long hole portion of the shift link 206 through the shift cam stud 208 is shifted.

The shift cam stud 208 is interlocked with the long hole portion of the shift link 206, and changes the rotational movement of the shift cam 207 to linear movement in a direction of the shaft of the sheet discharge roller 205.

The shift home position sensor 209 detects the position of the shift link 206, and sets the detected position as a home position (a standby position).

The binding tool 210 is a tool or device for binding a bundle of sheets by squeeze crimping without using a metal staple. In the present embodiment, the binding tool 210 has a pair of toothed dies consisting of upper and lower toothed dies having alternate recessed and projecting parts on the surface thereof, and holds a bundle of sheets between the toothed dies, thereby deforming the sheets and entwining fibers of the sheets. As this type of the binding tool 210, for example, a known binding tool as disclosed in Japanese Examined Utility Model Application Publication No. S36-013206 can be used. Furthermore, there can be used a binding tool that make a U-shaped cut in a sheet bundle and folds up the U-shaped cut, and also cuts a slit near the base of the folded portion, and puts the free end of the folded portion through the slit so as not to come untied, thereby binding the bundle of sheets without using a metal staple (for example, see Japanese Examined Utility Model Application Publication No. S37-007208). Incidentally, a means for binding a bundle of sheets is not limited to the binding tool described in the present embodiment, and can be any tools or devices having a function of binding a bundle of sheets by squeeze crimping, i.e., by crimping sheets thereby entwining fibers of the sheets.

A sheet-end sensor 220 as a sheet-end detecting means is a sensor that detects the side edge of a sheet. When sheets are aligned, sheets are aligned on the basis of positions of the sheets detected by this sensor.

A binding-tool home position sensor 221 is a sensor that detects the position of the binding tool 210 capable of moving in a sheet width direction perpendicular to a sheet conveying direction. A position of the binding tool 210 at which the binding tool 210 does not obstruct the conveyance of even a maximum size of sheet is set as a home position (a standby position) of the binding tool 210, and this position is detected by the binding-tool home position sensor 221.

A binding-tool movement guide rail 230 is a rail for guiding the movement of the binding tool 210 so that the binding tool 210 can stably move in the sheet width direction.

A conveyance path 240 is a usual path through which a received sheet is conveyed and discharged. The branch path 241 is provided to lay sheets on top of one another in correct alignment, and is a conveyance path into which a sheet is brought from the trailing end side by switchback.

A butting face 242 is a reference face against which the trailing end of a sheet is butted to be aligned in a binding processing tray (a stapling tray) 243 as a sheet container in which sheets to be bound are contained. A toothed die 261 is, for example, a pair of toothed dies whose recessed and projecting parts are in engagement with each other in the present embodiment, and holds sheets between the pair of toothed dies, thereby deforming the sheets and entwining fibers of the sheets.

Figure 5:
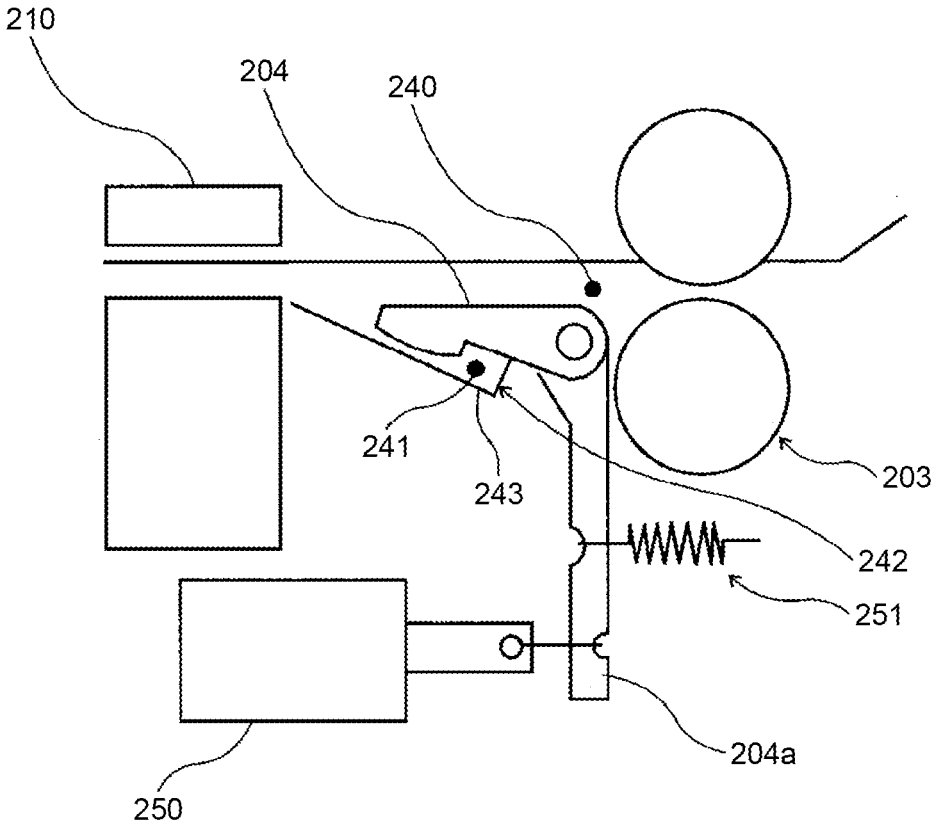
FIG. 5 is an explanatory diagram illustrating a home position of a bifurcating claw that diverts a sheet fed into the sheet post-processing apparatus.
Figure 6:
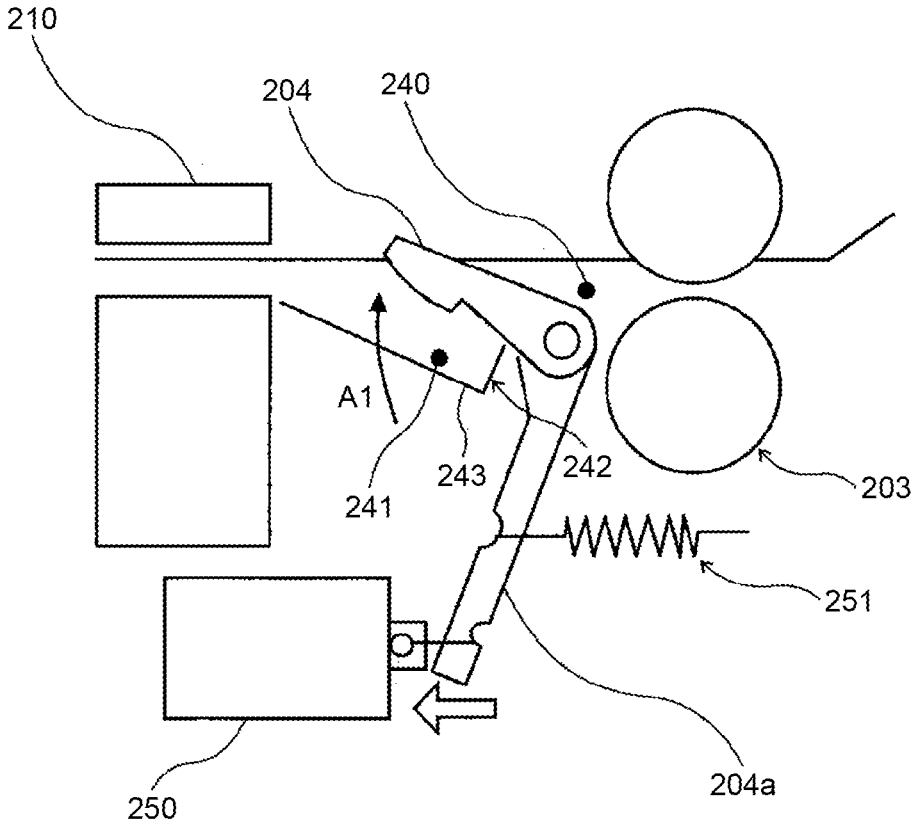
FIG. 6 is an explanatory diagram illustrating the position of the bifurcating claw when the sheet fed into the sheet post-processing apparatus is diverted to a branch path.

FIGS. 5 and 6 are explanatory diagrams showing an example of a detailed configuration of the bifurcating claw 204, which diverts a sheet conveyed into the sheet post-processing apparatus 201, and its surroundings. FIG. 5 is an explanatory diagram showing a home position of the bifurcating claw 204. FIG. 6 is an explanatory diagram showing the position of the bifurcating claw when a sheet fed into the sheet post-processing apparatus 201 is diverted to the branch path 241.

The bifurcating claw 204 is configured to be turnable so as to switch between the conveyance path 240 and the branch path 241. As shown in FIG. 5, the rotational position enabling a sheet received from the right side in FIG. 5 to be conveyed freely is the home position of the bifurcating claw 204. The bifurcating claw 204 constantly pressurized by a spring 251 as shown in FIG. 5. The spring 251 is hooked on a bifurcating-claw moving lever 204*a*. A bifurcating solenoid 250 is also connected to the bifurcating-claw moving lever 204*a* through a link. A conveyance face of the branch path 241 and the bifurcating claw 204 are configured to be able to hold a sheet on the conveyance path therebetween. The conveyance path is switched by turning on the bifurcating solenoid 250, thereby the bifurcating claw 204 turns in a direction indicated by the arrow A1 shown in FIG. 6 to block the conveyance path 240, and the sheet is guided to the branch path 241.

In the present embodiment, a means for laying multiple sheets to be bound on top of one another into a bundle is composed of the pair of inlet rollers 203, the pair of sheet discharge rollers 205, the bifurcating claw 204, the binding processing tray 243 having the butting face 242, and drive sources for driving these, etc.

Figure 7:
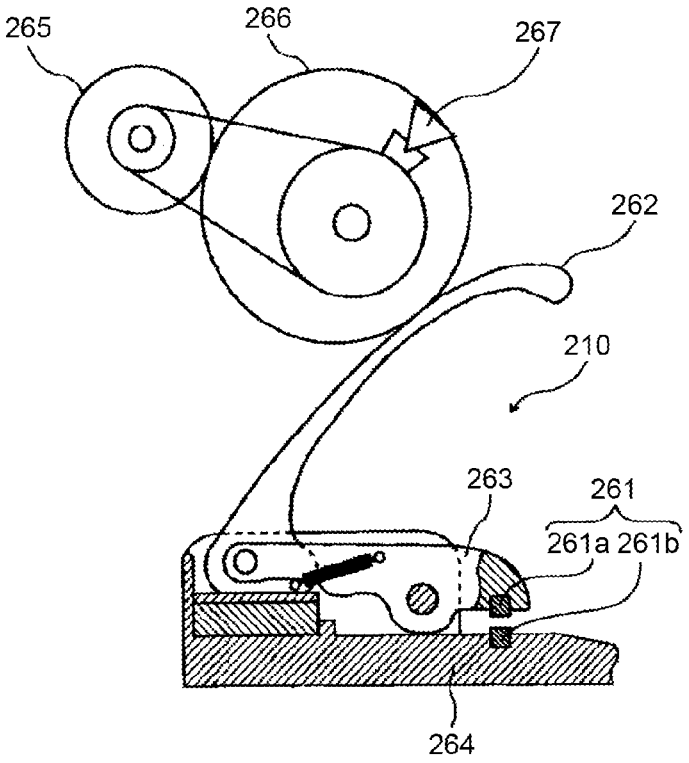
FIG. 7 is an explanatory diagram illustrating an example of a binding tool of which the toothed die is in an open state and its drive mechanism.
Figure 8:
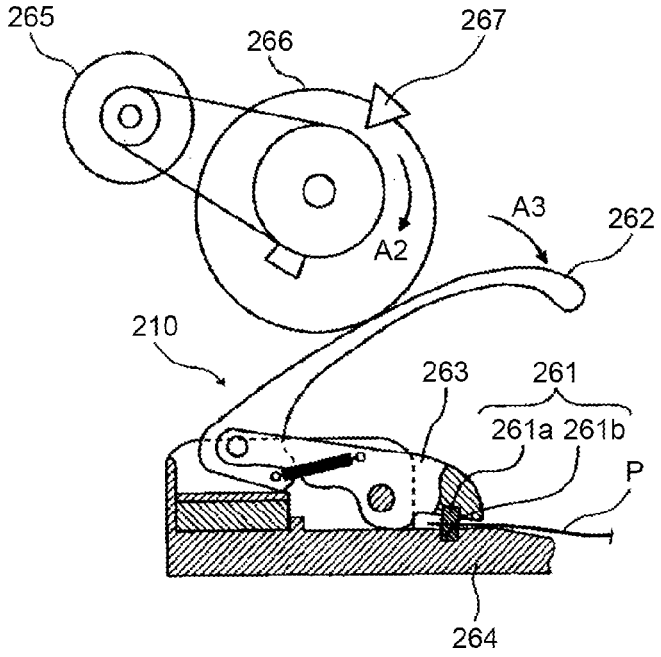
FIG. 8 is an explanatory diagram illustrating an example of the binding tool of which the toothed die is in a closed state and its drive mechanism.
Figure 9:
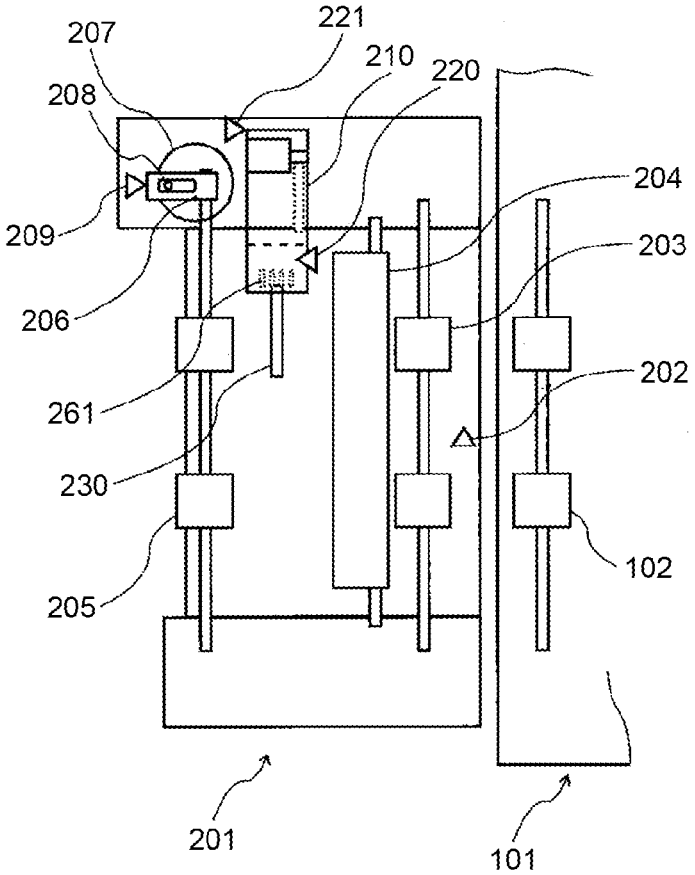
FIGS. 9(*a*) and 9(*b*) are plan and front views illustrating the state of the inside of the sheet post-processing apparatus after completion of an initialization process.
Figure 9:
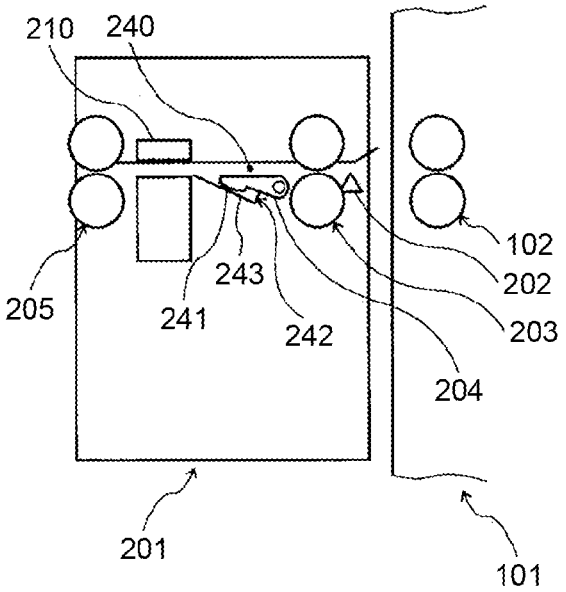

FIGS. 7 and 8 are explanatory diagrams illustrating an example of a configuration and operation of the binding tool 210. FIG. 7 is an explanatory diagram illustrating an example of the binding tool 210 of which the toothed die 261 is in an open state and its drive mechanism, and FIG. 8 is an explanatory diagram showing an example of the binding tool 210 of which the toothed die 261 is in a closed state and its drive mechanism. Incidentally, the configuration of the binding tool 210 is not limited to those shown in FIGS. 7 and 8.

In FIG. 7, the toothed die 261 includes an upper toothed die 261*a* and a lower toothed die 261*b*, and the upper and lower toothed dies 261*a* and 261*b* are shaped so as to be in engagement with each other. The upper toothed die 261*a* is attached to the tip of a movable link member 263. The lower toothed die 261*b* is attached to a fixed link member 264 so as to be opposed to the upper toothed die 261*a*. The movable link member 263 moves in accordance with a turning movement of a pressure lever 262, thereby the upper and lower toothed dies 261 come close or move away. The pressure lever 262 turns in a direction indicated by the arrow A3 shown in FIG. 8 in accordance with rotation of a cam 266 in a direction indicated by the arrow A2 shown in FIG. 8. The cam 266 is given a drive force by a drive motor 265 and rotates, and is controlled to be located at a detection position on the basis of information of detection by a cam home position sensor 267. The detection position of the cam home position sensor 267 is set as a home position (a standby position) of the cam 266; when the cam 266 is located at the home position, the toothed die 261 is in an open state.

When sheets are bound, the binding tool 210 and its drive mechanism operate as shown in FIG. 8. In a state where the pair of toothed dies 261 is open, sheets P are inserted between the pair of toothed dies 261, and the cam 266 is rotated in the direction indicated by the arrow A2 shown in FIG. 8 by rotation of the drive motor 265. By displacement of a cam face of the cam 266, the pressure lever 262 turns in the direction indicated by the arrow A3 shown in FIG. 8. This turning force is increased through the movable link member 263 using a lever, and is transmitted to the upper toothed die 261*a* located at the end of the movable link member 263. When the cam 266 has rotated by a certain amount, the upper toothed die 261*a* is engaged with the lower toothed die 261*b*, thereby the sheets P are held between the upper and lower toothed dies 261*a* and 261*b*. By being held between the upper and lower toothed dies 261*a* and 261*b*, the sheets P are deformed by application of pressure, and fibers of adjacent sheets are entwined, thereby the sheets P are bound. After that, the drive motor 265 rotates in the reverse direction, and stops at the detection position of the cam home position sensor 267. Furthermore, the pressure lever 262 has elasticity, so that when the pressure lever 262 is overloaded, the pressure lever 262 deflects to relieve the overload.

In the binding tool 210 configured as shown in FIGS. 7 and 8, with a change in binding force, which is a force of engagement of the pair of toothed dies 261 that holds sheets P between them while applying pressure to the sheets P to deform the sheets P, the binding strength when the sheet bundle is bound by entwining fibers of the sheets is changed. The binding force when the pair of toothed dies 261 is engaged is changed by torque generated when the pressure lever 262 is turned through the cam 266, i.e., torque (moment of force) generated in the drive motor 265. The torque generated in the drive motor 265 varies according to motor current supplied to the drive motor 265. Therefore, by controlling the motor current supplied to the drive motor 265, the binding force of the binding tool 210 can be changed according to a binding mode, such as an all-along binding mode and a temporary binding mode, thereby changing the binding strength to bind a sheet bundle.

Subsequently, an example of binding operation of the sheet post-processing apparatus 201 is explained.

FIGS. 9 to 17 are plan and front views of the sheet post-processing apparatus 201 when performing the present example of binding operation. In each of FIGS. 9 to 17, each of FIG. (a) is a plan view of the sheet post-processing apparatus 201, and each of FIG. (b) is a front view of the sheet post-processing apparatus 201.

First, as shown in FIGS. (a)A and 9(*b*), when output of a sheet from the image forming apparatus main body 101 starts, the units move to their home positions, and an initialization process (an initial process) is completed.

Figure 10:
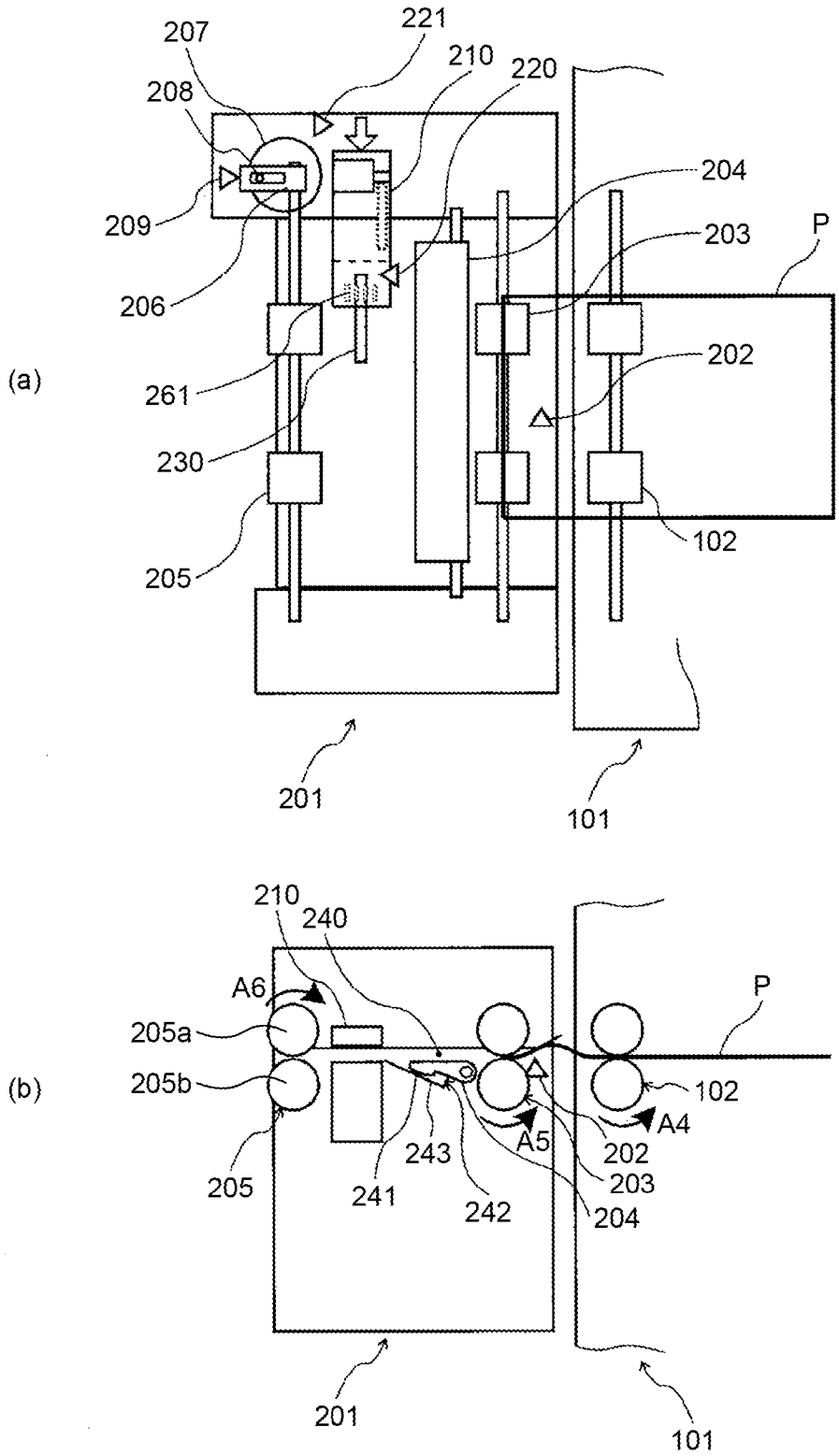
FIGS. 10(*a*) and 10(*b*) are plan and front views showing the state of the inside of the sheet post-processing apparatus when receiving a sheet.

Then, as shown in FIGS. 10(*a*) and 10(*b*), before the sheet P output from the image forming apparatus main body 101 is brought into the sheet post-processing apparatus 201, the sheet post-processing apparatus 201 receive information on an operation mode and information on the sheet P, and goes into a receiving standby state on the basis of the information. Incidentally, in the present embodiment, the sheet post-processing apparatus 201 has three operation modes: straight mode, shift mode, and binding mode; however, operation modes are not limited to these.

Here, respective operations of the sheet post-processing apparatus 201 in the straight mode and the shift mode are explained.

First, the operation of the sheet post-processing apparatus 201 in the straight mode is explained.

When the sheet post-processing apparatus 201 has received information indicating the straight mode and information on sheets P, the sheet post-processing apparatus 201 goes into a receiving standby state in the straight mode. Specifically, the pair of inlet rollers 203 and a sheet discharge drive roller 205*a* start rotating in respective rotation directions (a direction indicated by the arrow A5 and a direction indicated by the arrow A6 shown in FIG. 10(*b*)) so as to convey a received sheet P in a predetermined conveying direction (to the left in FIG. 10). Sheets P are fed into the sheet post-processing apparatus 201 in such a receiving standby state by rotation (to a direction indicated by the arrow A4 shown in FIG. 10(*b*)) of the sheet discharge roller 102 of the image forming apparatus main body 101. The sheets P fed into the sheet post-processing apparatus 201 are sequentially conveyed by the pair of inlet rollers 203 and a pair of sheet discharge rollers 205 consisting of the sheet discharge drive roller 205*a* and a sheet discharge driven roller 205*b*, and discharged to the outside of the sheet post-processing apparatus 201. Then, when the last sheet has been discharged, the pair of inlet rollers 203 and the pair of sheet discharge rollers 205 stop rotating.

Next, the operation of the sheet post-processing apparatus 201 in the shift mode is explained.

When the sheet post-processing apparatus 201 has received information indicating the shift mode and information on sheets P, the sheet post-processing apparatus 201 goes into a receiving standby state in the shift mode. Specifically, in the same manner as in the straight mode, the pair of inlet rollers 203 and the pair of sheet discharge rollers 205 start rotating in respective rotation directions so as to convey a received sheet P in the predetermined conveying direction (to the left in FIG. 10). Sheets P are fed into the sheet post-processing apparatus 201 in such a receiving standby state from the image forming apparatus main body 101. The sheets fed into the sheet post-processing apparatus 201 are sequentially conveyed by the pair of inlet rollers 203 and the pair of sheet discharge rollers 205 like in the straight mode. When the trailing end of each sheet has passed through the pair of inlet rollers 203, the shift cam 207 rotates by a certain amount, and the sheet discharge drive roller 205*a* moves together with the sheet discharge driven roller 205*b* in an axial direction. At this time, the sheet P also moves along with the movement of the pair of sheet discharge rollers 205. When the sheet P has been discharged to the outside of the sheet post-processing apparatus 201, the shift cam 207 rotates to return to the home position and stands by for the next sheet. This movement of the sheet discharge drive roller 205*a* is repeated until all sheets for a "copy" have been discharged. When a sheet for the next copy has been brought into the sheet post-processing apparatus 201, the shift cam 207 rotates in a reverse direction of the last rotation direction, and the sheet moves to the opposite side and is discharged to the outside of the sheet post-processing apparatus 201.

On the other hand, when the sheet post-processing apparatus 201 has received information indicating the binding mode and information on sheets P, the sheet post-processing apparatus 201 goes into a receiving standby state in the binding mode. In the receiving standby state in the binding mode, the pair of inlet rollers 203 stops rotating, and the sheet discharge drive roller 205*a* starts rotating in a direction indicated by the arrow A6 shown in FIG. 10(*b*) so as to convey a received sheet P in a predetermined conveying direction (to the left in FIG. 10). Furthermore, the binding tool 210 moves to the standby position (the home position) retracted by a certain amount from the end of the sheet P in the width direction, and stands by for the sheet P.

After that, when the sheet P has been brought into the sheet post-processing apparatus 201, the inlet sensor 202 detects the leading end of the sheet P. From the timing at which the leading end of the sheet P has been detected, the sheet P is conveyed by a predetermined distance (a distance for which the leading end of the sheet P is butted against the nip of the pair of inlet rollers 203, thereby the sheet P by bends a certain amount). After the conveyance, the pair of inlet rollers 203 starts rotating. This corrects a skew of the sheet P.

Figure 11:
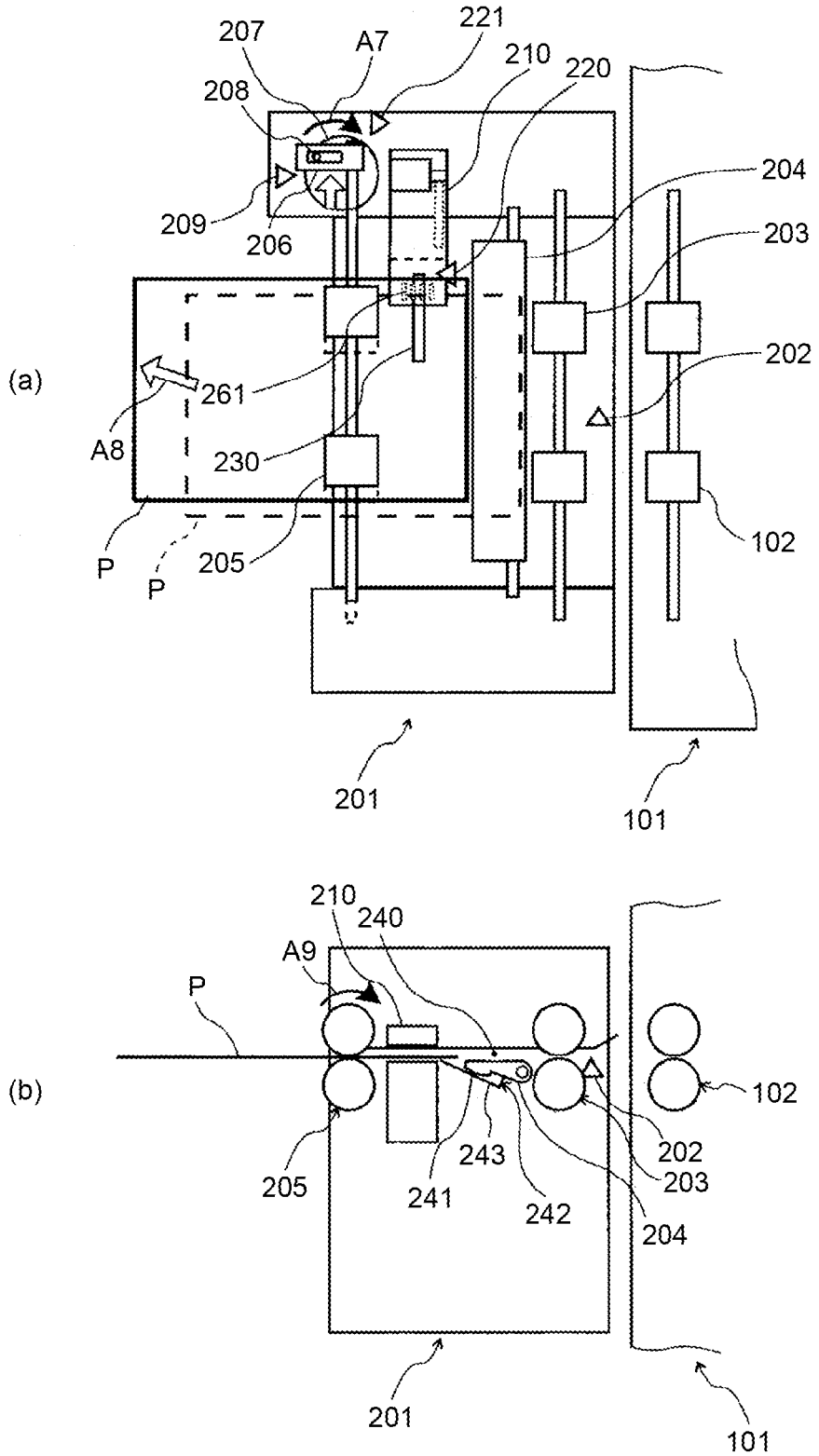
FIGS. 11(*a*) and 11(*b*) are plan and front views illustrating the state of the inside of the sheet post-processing apparatus when determining the position of the sheet in a width direction.

Then, as shown in FIGS. 11(*a*) and 11(*b*), a conveyance amount of the sheet P is calculated on the basis of information of detection by the inlet sensor 202 that has detected the trailing end of the sheet P, and position information of the sheet P is grasped. When the trailing end of the sheet P has passed through the nip of the pair of inlet rollers 203, the pair of inlet rollers 203 stops rotating to receive the next sheet. At the same time, the shift cam 207 rotates in a direction indicated by the arrow A7 shown in FIG. 11(*a*) (a clockwise direction), and the pair of sheet discharge rollers 205 start moving in the axial direction together with the sheet P. Accordingly, the sheet P is conveyed obliquely in a direction indicated by the arrow A8 shown in FIG. 11(*a*). After that, when the sheet-end sensor 220 attached to or embedded in the binding tool 210 has detected the sheet P, the shift cam 207 stops rotating and then rotates in the reverse direction. This reverse rotation of the shift cam 207 is stopped when the sheet-end sensor 220 goes into a non-detectable state. After completion of the above operation, the rotation of the sheet discharge drive roller 205*a* in a direction indicated by the arrow A9 shown in FIG. 11(*b*) is stopped when the trailing end of the sheet P has reached a predetermined position, i.e., when the trailing end of the sheet P has passed through the tip of the bifurcating claw 204.

Figure 12:
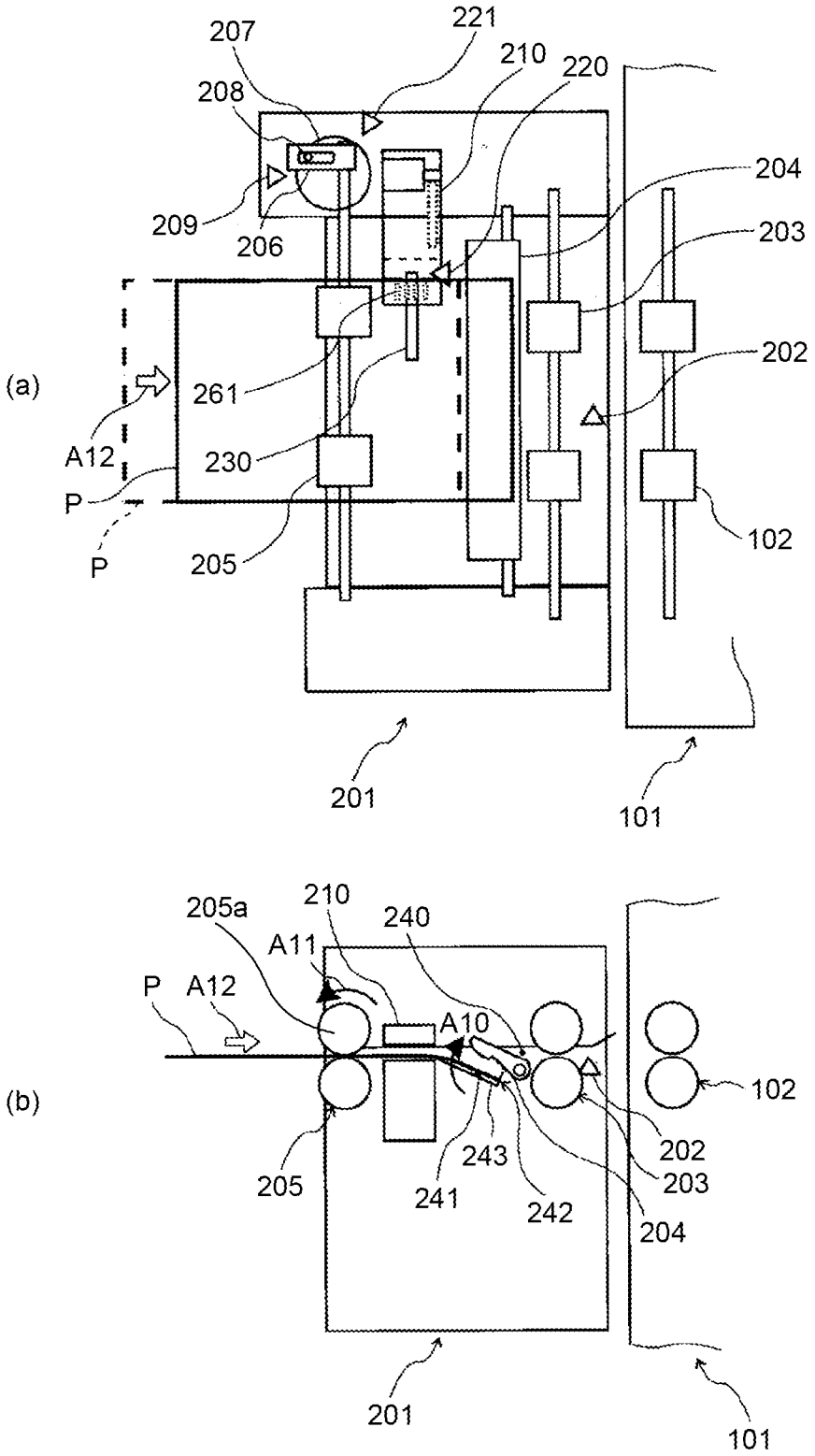
FIGS. 12 (*a*) and 12(*b*) are plan and front views illustrating the state of the inside of the sheet post-processing apparatus when determining the position of the trailing end of the sheet.

Then, as shown in FIGS. 12 (*a*) and 12(*b*), the bifurcating claw 204 turns in a direction indicated by the arrow A10 shown in FIG. 12(*b*) (a clockwise direction), thereby the conveyance path is switched. After that, the sheet discharge drive roller 205*a* rotates backward in a direction indicated by the arrow A11 (a counterclockwise direction), and the sheet P is conveyed in a direction indicated by the arrow A12 so that the trailing end of the sheet P is brought into the branch path 241. By this conveyance, the sheet P is butted against the butting face 242 of the binding processing tray 243 thereby being aligned, and the pair of sheet discharge rollers 205 stops rotating. Here, the pair of sheet discharge rollers 205 is set to create a weak conveyance force so that the sheet P skids when butted.

Figure 13:
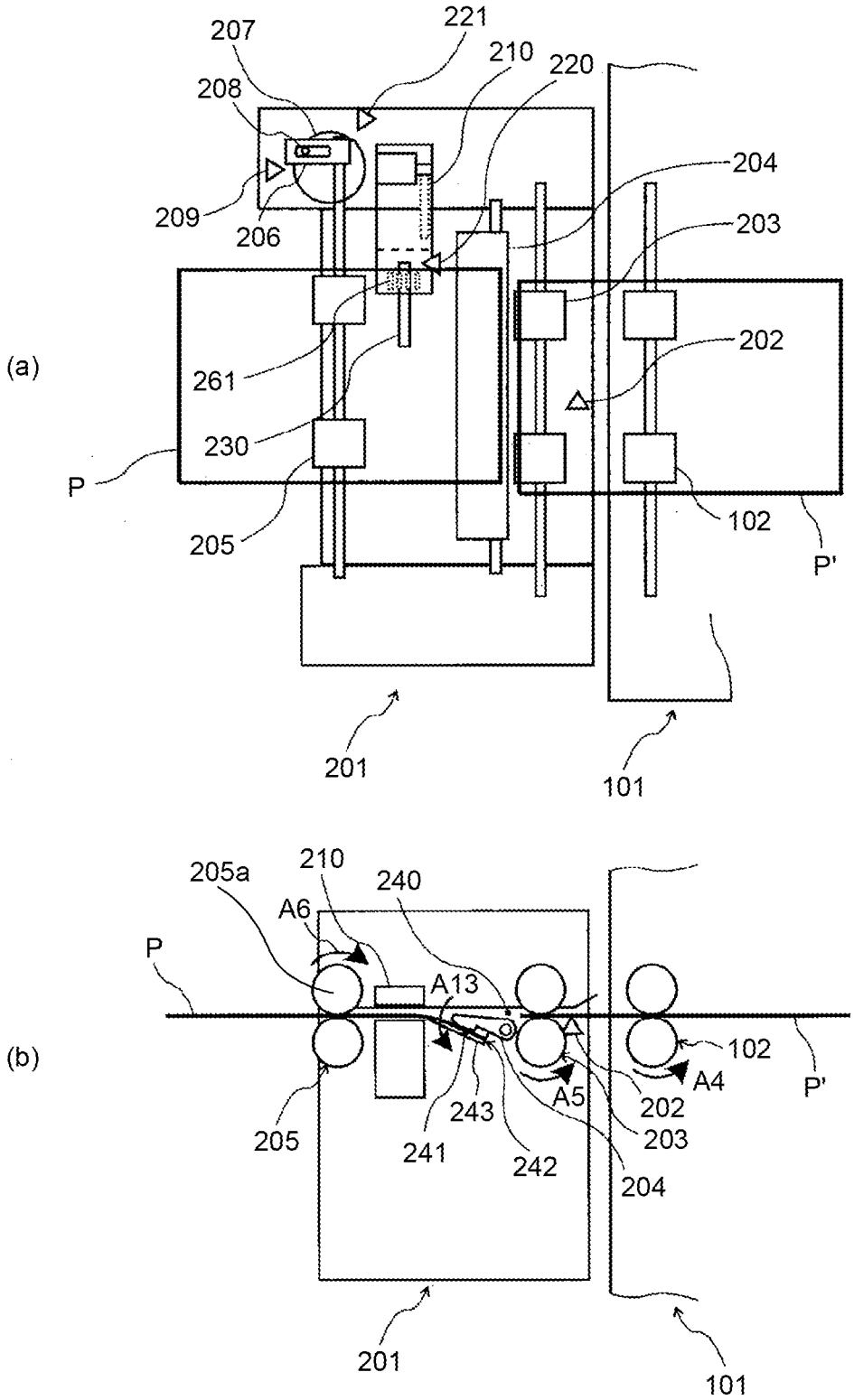
FIGS. 13(*a*) and 13(*b*) are plan and front views illustrating the state of the inside of the sheet post-processing apparatus when receiving a subsequent sheet.

Then, as shown in FIGS. 13(*a*) and 13(*b*), the bifurcating claw 204 turns in a direction indicated by the arrow A13 shown in FIG. 13(*b*) (a counterclockwise direction), thereby the trailing end of the sheet P located in the branch path 241 is strongly pressed by a contact surface of the bifurcating claw 204 and stands still. When a subsequent sheet P' has been output from the image forming apparatus main body 101, a skew of the sheet P' is corrected by means of the pair of inlet rollers 203 in the same manner as the first sheet P. The pair of inlet rollers 203 starts rotating, and at the same time, the sheet discharge drive roller 205*a* also starts rotating in a rotation direction for conveying the sheet (the direction indicated by the arrow A6 shown in FIG. 13(*b*)).

Figure 14:
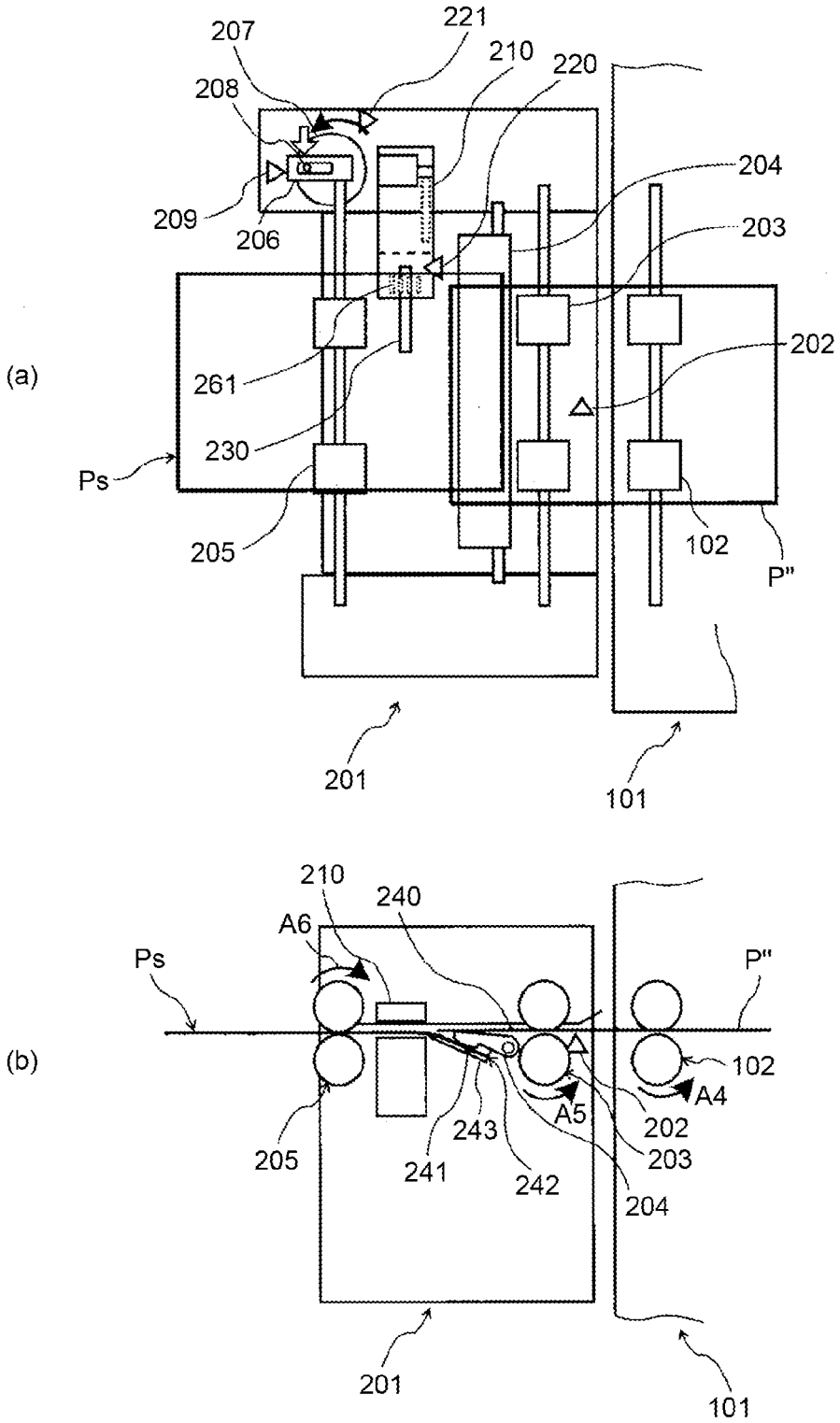
FIGS. 14 (*a*) and 14(*b*) are plan and front views illustrating the state of the inside of the sheet post-processing apparatus when receiving a further subsequent sheet.

Then, as shown in FIGS. 14(*a*) and 14(*b*), as for the second and subsequent sheets P" . . . , the same operations as illustrated in FIGS. 11(*a*), 11(*b*), 12(*a*), and 12(*b*) are performed, and the sheets are sequentially moved and laid on top of one another, thereby a sheet bundle Ps in correct alignment is stacked on the conveyance path.

Figure 15:
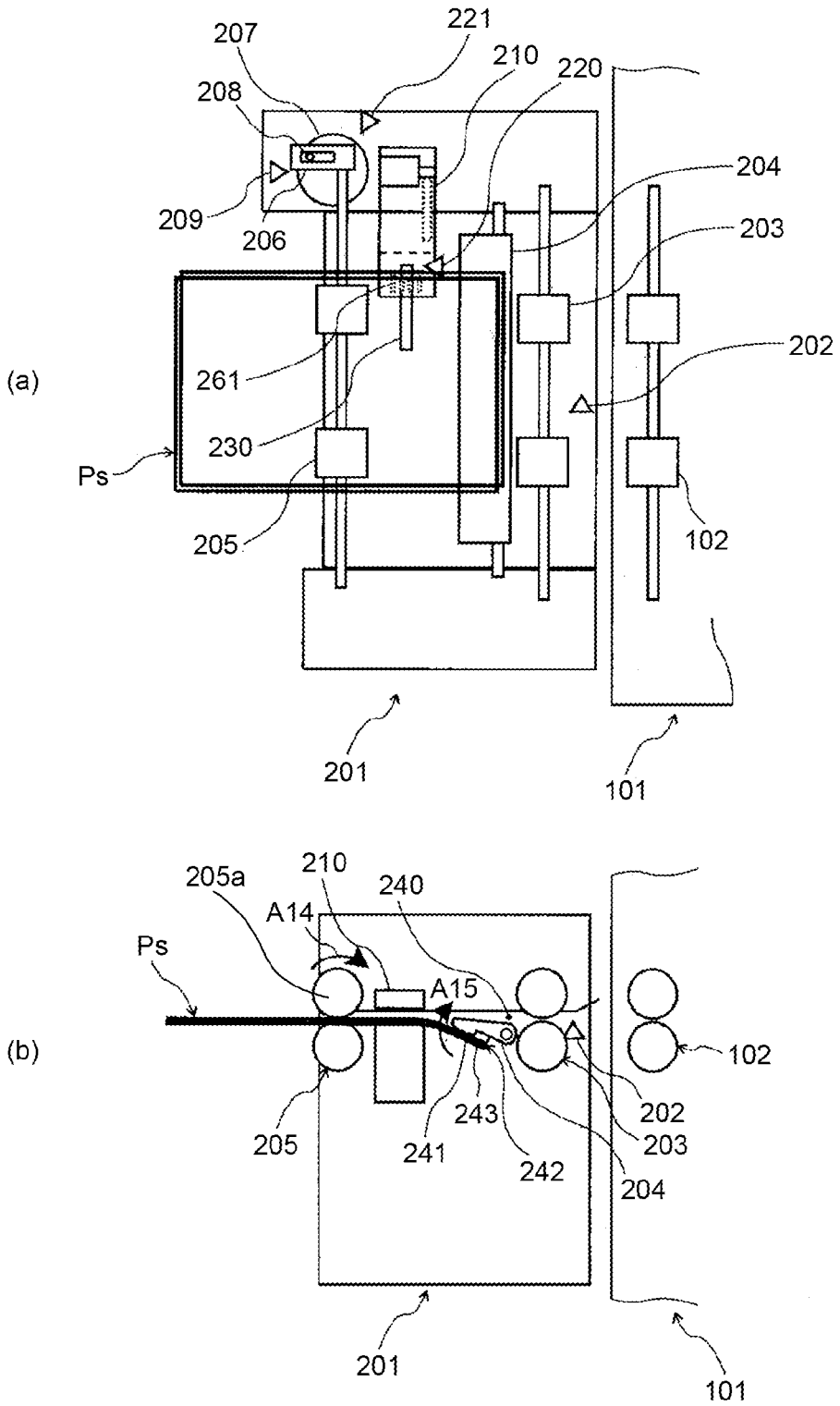
FIGS. 15(*a*) and 15(*b*) are plan and front views illustrating the state of the inside of the sheet post-processing apparatus before starting a binding process upon completion of a process of aligning a sheet bundle.

Then, as shown in FIGS. 15(*a*) and 15(*b*), when an operation of laying the last sheet on top of the sheet bundle Ps in correct alignment has been completed, the sheet discharge drive roller 205*a* rotates in a direction indicated by the arrow A14 shown in FIG. 15B (a clockwise direction) so as to convey the sheet bundle Ps by a certain amount and then stops rotating. By this motion of the sheet discharge drive roller 205*a*, bending of each sheet due to butting of the trailing end of the sheet against the butting face 242 can be eliminated. After that, the bifurcating claw 204 turns in a direction indicated by the arrow A15 shown in FIG. 15(*b*) (a clockwise direction), thereby the direction of the tip thereof is switched, and the sheet bundle Ps is released from a pressing force put thereon.

Figure 16:
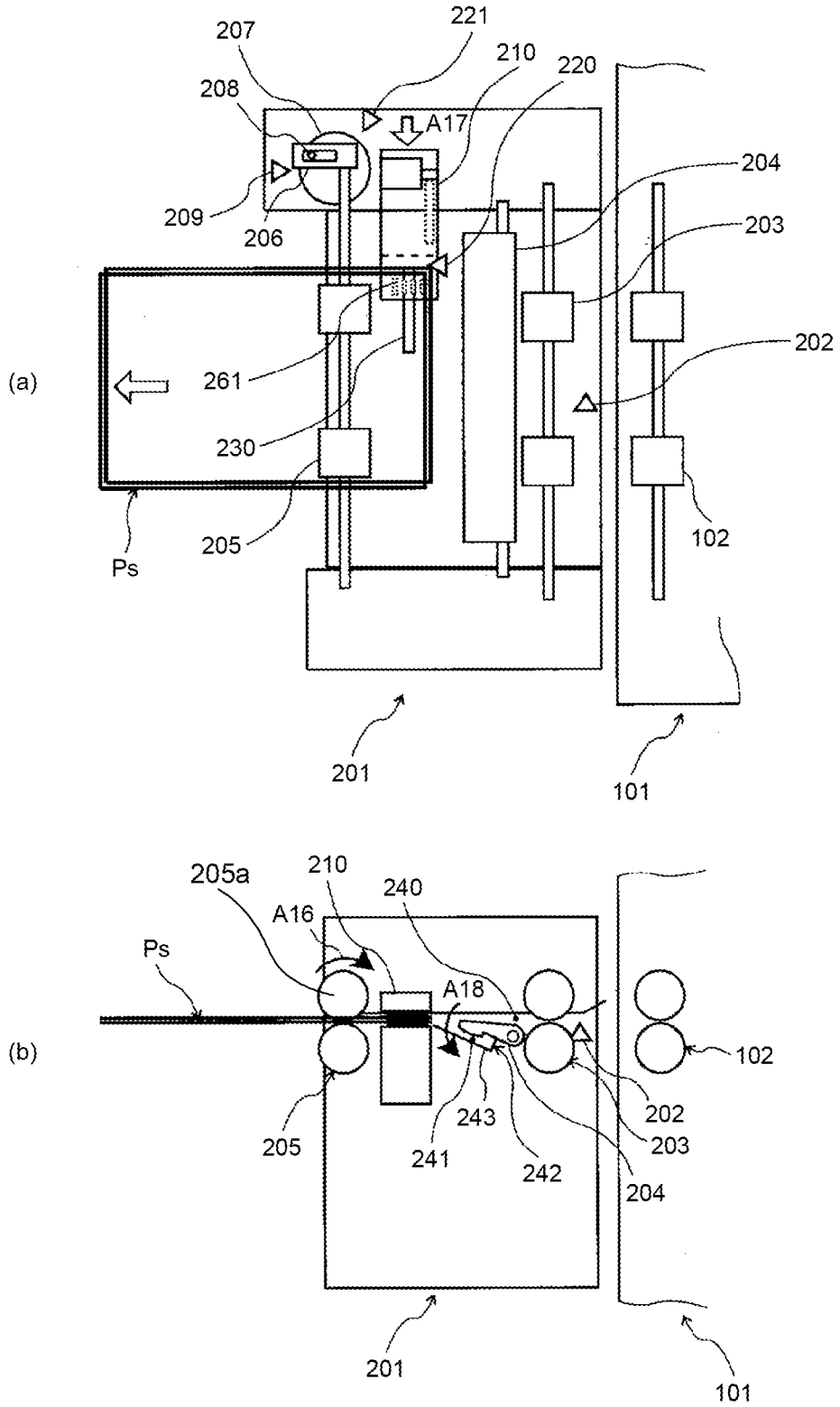
FIGS. 16(*a*) and 16(*b*) are plan and front views illustrating the state of the inside of the sheet post-processing apparatus when starting discharging the sheet bundle after completion of the binding process.

Then, as shown in FIGS. 16(*a*) and 16(*b*), the sheet discharge drive roller 205*a* rotates in a direction indicated by the arrow A16, thereby the sheet bundle Ps is conveyed by a distance for which the position of the toothed die 261 of the binding tool 210 coincides with the sheet processing position (binding position) and then stopped. Accordingly, alignment in a sheet conveying direction between the position of the toothed die 261 of the binding tool 210 and the sheet processing position (binding position) is adjusted. Furthermore, the binding tool 210 moves in a direction indicated by the arrow A17 shown in FIG. 16(*a*) by a distance for which the position of the toothed die 261 of the binding tool 210 coincides with the sheet processing position, and then stops. Accordingly, alignment in a sheet width direction between the position of the toothed die 261 of the binding tool 210 and the sheet processing position (binding position) is adjusted. At this time, the bifurcating claw 204 turns in a direction indicated by the arrow A18 shown in FIG. 16(*b*) (a counterclockwise direction), thereby the direction of the tip thereof is switched, and the bifurcating claw 204 gets back into a sheet receivable state. After that, the drive motor 265 of the binding tool 210 is turned on, and the sheet bundle Ps is squeezed by application of pressure by the toothed die 261, thereby fibers of the sheets P are entwined, and the sheets P are joined, thus the sheet bundle Ps is bound.

Figure 17:
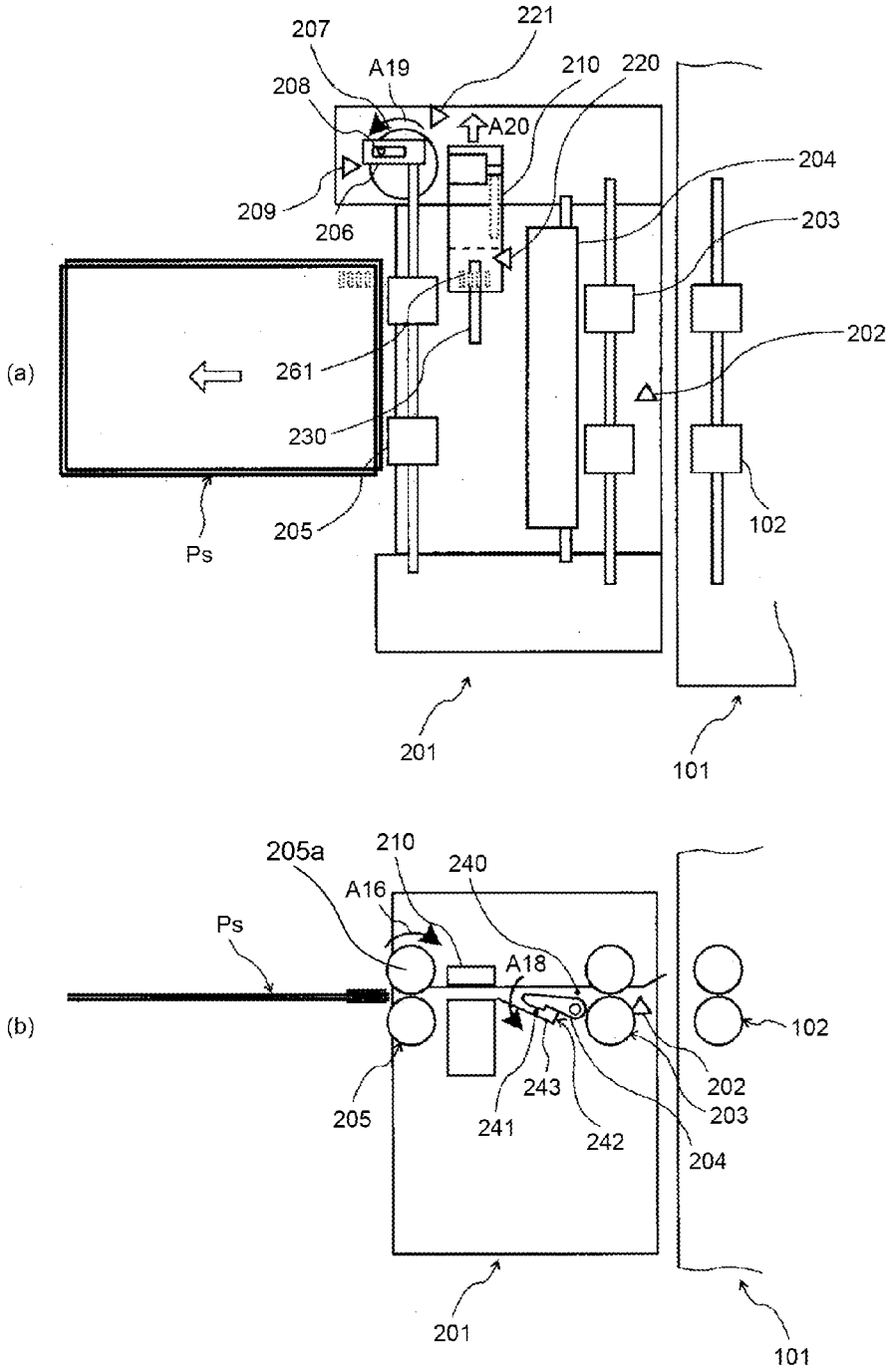
FIGS. 17 (*a*) and 17(*b*) are plan and front views illustrating the state of the inside of the sheet post-processing apparatus when discharging the sheet bundle after completion of the binding process.

Then, as shown in FIGS. 17(*a*) and 17(*b*), the sheet discharge drive roller 205*a* rotates in the direction indicated by the arrow A16, and the bound sheet bundle Ps is discharged to the outside of the sheet post-processing apparatus 201. Then, after the discharge of the sheet bundle Ps, the shift cam 207 rotates in a direction indicated by the arrow A19 and returns to the home position, and the binding tool 210 moves in a direction indicated by the arrow A20 and returns to the home position. Accordingly, the operation for the process of binding the sheet bundle Ps is completed.

Subsequently, there is described a method for attaching the toothed die 261 provided as a pair of crimping members which is a feature of the present embodiment.

Figure 18:
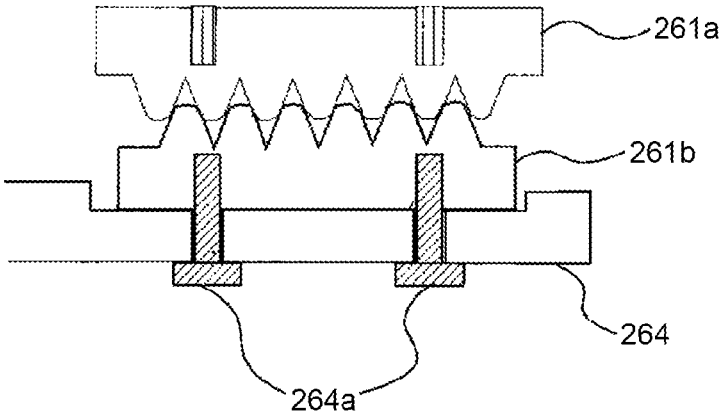
FIG. 18 is a diagram for explaining attachment of the toothed die.
Figure 18:
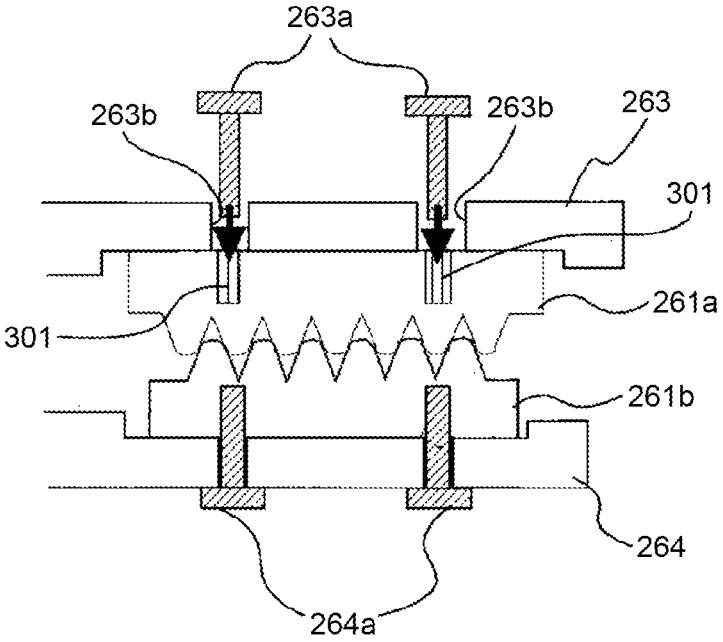

FIGS. 18(*a*) and 18(*b*) are diagrams for explaining attachment of the toothed die.

First, as shown in FIG. 18(*a*), the lower toothed die 261*b* is fixed to the fixed link member 264 with screws 264*a*. Then, the upper toothed die 261*a* is put on the lower toothed die 261*b* fixed to the fixed link member 264 in a manner engaged with each other.

Then, as shown in FIG. 18(*b*), the movable link member 263 is put on the upper toothed die 261*a* engaged with the lower toothed die 261*b*, and the upper toothed die 261*a* is fixed to the movable link member 263 with screws 263*a*.

As shown in FIG. 18(*b*), the diameter of a through-hole 263*b* through which the screw 263*a* of the movable link member 263 penetrates is larger than the diameter of a threaded portion of the screw 263*a*. Specifically, a value obtained by subtracting the diameter of the threaded portion from the diameter of the through-hole 263*b* (a gap between the through-hole 263*b* and the threaded portion) is set to be equal to or larger than a position error of the movable link member 263 with respect to the fixed link member 264. Accordingly, even if the center of the through-hole 263*b* deviates from the center of a screw hole 301 due to manufacturing errors of the movable link member 263 and the fixed link member 264, etc., the upper toothed die 261*a* can be fixed to the movable link member 263.

In this manner, in the present embodiment, in a state where the upper toothed die 261*a* is properly engaged with the lower toothed die 261*b*, the upper toothed die 261*a* is fixed to the movable link member 263. Accordingly, it is possible to prevent the upper and lower toothed dies 261*a* and 261*b* from being off the proper engagement position due to an attachment error or the like after the upper and lower toothed dies 261*a* and 261*b* have been attached on the respective members. Consequently, it is possible to bind a sheet bundle with a stable binding force. Accordingly, it is possible to prevent a crimped portion of the sheet from being torn due to stronger-than-prescribed engagement of the upper and lower toothed dies 261*a* and 261*b*, and possible to prevent a sheet bundle from being bound with a weaker force than the prescribed binding force due to weaker-than-prescribed engagement of the upper and lower toothed dies 261*a* and 261*b*.

Subsequently, an example of modification of the toothed die 261 is explained.

Figure 19:
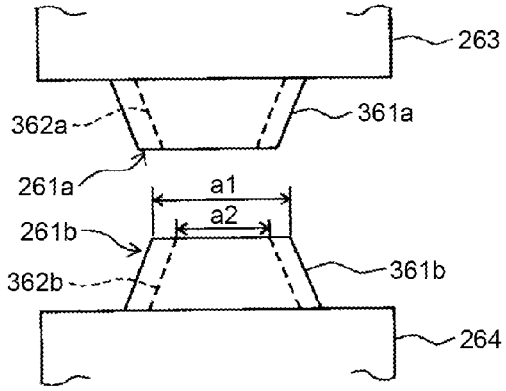
FIG. 19 is a schematic configuration diagram of an example of a modified toothed die.
Figure 20:
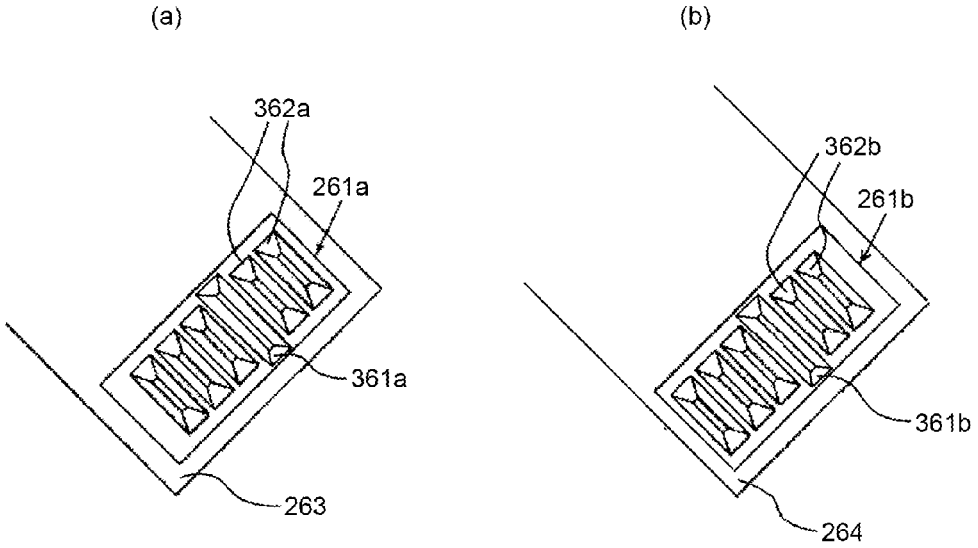
FIG. 20(*a*) is a diagram illustrating an upper toothed die of the modified toothed die.

FIG. 19 is a schematic configuration diagram of an example of a modified toothed die. FIG. 20(*a*) is a diagram showing the upper toothed die 261*a* of the modified toothed die, and FIG. 20(*b*) is a diagram showing the lower toothed die 261*b* of the modified toothed die.

In the present embodiment, the upper toothed die 261*a* engaged with the lower toothed die 261*b* is fixed to the movable link member 263 with the screws 263*a*. At the time of the fixation with the screws 263*a*, a force in a direction of screwing the screws 263*a* is applied to the upper toothed die 261*a*, and the upper toothed die 261*a* attempts to turn in the screwing direction. To prevent such turning, by increasing the length of the toothed die 261 in a direction of tooth trace (a direction perpendicular to a direction of alignment of teeth), turning motion of the upper toothed die 261*a* can be suppressed. However, if all teeth are lengthened in the direction of tooth trace, a contact area to be in contact with a sheet bundle is increased. As a result, pressure applied to the sheet bundle is decreased, and therefore a binding force is reduced.

To cope with this problem, in this modification example, as shown in FIGS. 19, 20(*a*), and 20(*b*), a width dimension a1 of one of teeth as multiple projecting parts is set longer than width dimensions a2 of the other teeth (hereinafter, this lengthened tooth in the direction of tooth trace is referred to as a "long tooth"). In this modification example, as shown in FIG. 20(*a*), a tooth of the upper toothed die 261*a* located near the center is a long tooth 361*a*. Furthermore, a tooth of the lower toothed die 261*b* located near the center is a long tooth 361*b*, and it is configured that an inclined plane of the long tooth 361*a* of the upper toothed die 261*a* and an inclined plane of the long tooth 361*b* of the lower toothed die 261*b* come into contact when the upper and lower toothed dies 261*a* and 261*b* are engaged.

In this modification example, one of respective teeth of the upper and lower toothed dies 261*a* and 261*b* is made longer in the direction of tooth trace, thereby the following advantages are obtained. When the upper toothed die 261*a* engaged with the lower toothed die 261*b* is screwed to the movable link member 263, the upper toothed die 261*a* can be suppressed from turning in the direction of screwing the screws 263*a* by engagement of the long teeth of the upper and lower toothed dies 261*a* and 261*b*. Accordingly, a pressure distribution can be suppressed from changing in the direction of tooth trace, and therefore it is possible to achieve a stable binding force. Furthermore, the other teeth 362*a* and 362*b* of the upper and lower toothed dies 261*a* and 261*b* are not long in the direction of tooth trace; therefore, a decrease in pressure is suppressed, so a sheet bundle can be bound with a prescribed binding force.

In this modification example, a tooth located near the center of each toothed die is formed as a long tooth; alternatively, a long tooth can be formed in the end of each toothed die.

Subsequently, an example of modification of the sheet post-processing apparatus is explained.

Figure 21:
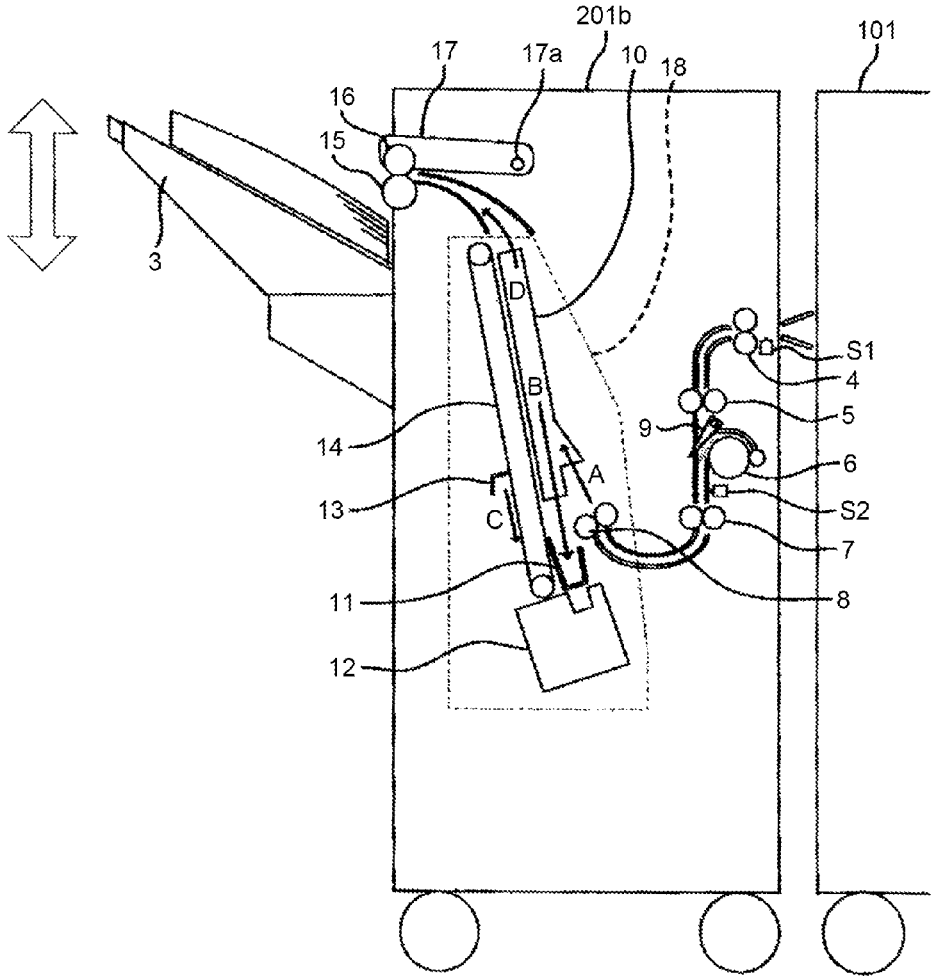
FIG. 21 is a diagram illustrating an example of a modified sheet post-processing apparatus.

FIG. 21 is a diagram illustrating an example of a modified sheet post-processing apparatus.

As shown in FIG. 21, a sheet output from the image forming apparatus main body 101 is fed into a sheet post-processing apparatus 201*b* according to the modification example. The sheet fed into the sheet post-processing apparatus 201*b* is conveyed by a conveyance roller 4 and a conveyance roller 5, and a moving force of the sheet turns a switching claw 9, thereby the sheet goes through a secured conveyance path and is conveyed in a direction indicated by the arrow A to an alignment unit 18 by a conveyance roller 7 and a conveyance roller 8. The sheet conveyed into an alignment fence 10 falls under its own weight in a direction indicated by the arrow B, and the conveying direction of the sheet is aligned by a trailing-end fence 11. The trailing end of the sheet is detected sequentially by sensors S1 and S2 in advance, and after a time in which the conveying direction of the sheet can be aligned, the width direction of the sheet is aligned by the alignment fence 10. By repeating this operation, multiple sheets are aligned one by one.

After the last sheet has been aligned, a binding tool 12 binds a bundle of aligned sheets by crimping, and a discharge belt 14 in the alignment unit 18 rotates in a direction indicated by the arrow C, and the sheet bundle is conveyed in a direction indicated by the arrow D by a discharge claw 13 attached to the discharge belt 14 so as to be discharged from the alignment unit 18. The sheet bundle is discharged and stacked on a tray 3 by a discharge roller 15 and a driven roller 16. The tray 3 has a mechanism for moving up and down according to the number of sheets stacked.

The driven roller 16 is attached to a conveyance guide plate 17, and is configured to be rotatable around a supporting point 17*a* so that the same conveying force can be obtained even when the thickness of a conveyed sheet bundle is changed, and also configured to apply pressure to the discharge roller 15 under the weight of the conveyance guide plate 17. That is the operation in a case of one copy.

In a case of two or more copies, the image forming apparatus main body 101 continuously feeds copies into a sheet post-processing apparatus 201*b* according to a second modification example at the same interval between the last sheet of a copy and the first sheet of the next copy as the other case.

Figure 22:
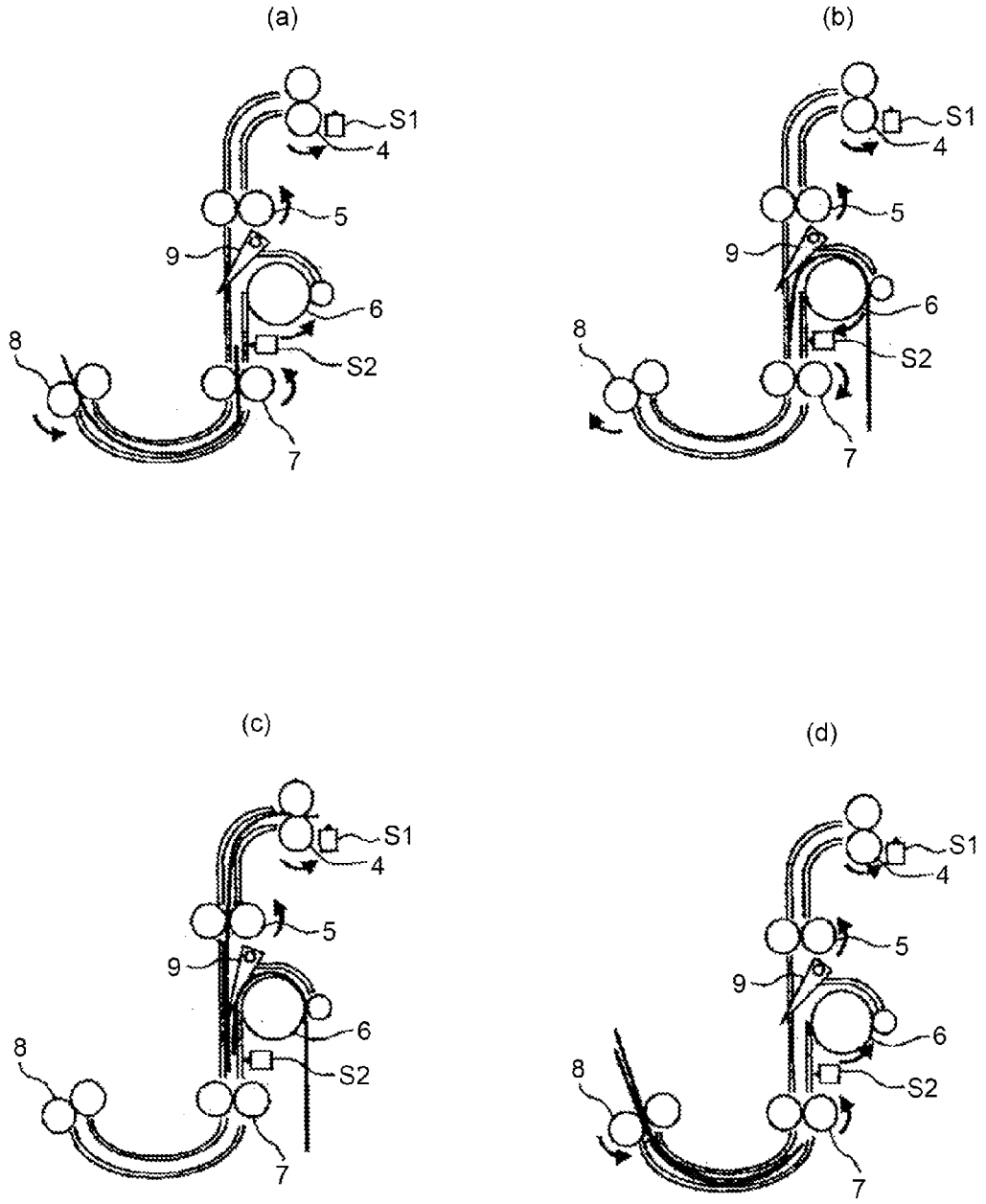
FIGS. 22(*a*) to 22(*d*) are diagrams for explaining processing operation for the second and subsequent copies.

The processing operation for the second and subsequent copies is explained with FIGS. 22(*a*), 22(*b*), 22(*c*), and 22(*d*).

The conveyance rollers 4 and 5 rotate in directions of arrows shown in FIG. 22(*a*), and the first sheet of the second copy is conveyed. The sensors S1 and S2 detects the trailing end of the sheet, and if the alignment unit 18 is not in a sheet receivable state, the conveyance rollers 6, 7, and 8 rotate in directions indicated by the arrows shown in FIG. 22(*b*), thereby conveying two sheets stacked on top of another. At this time, when the sensor S2 has detected the trailing end of these sheets, if the alignment unit 18 is in a sheet receivable state, the sheets are discharged as it is. On the other hand, if the alignment unit 18 is not in a sheet receivable state, the same operation as the first sheet is repeated. In this manner, with respect to the second and subsequent sheets of the second copy, the same operation as the first sheet is repeatedly performed until the alignment unit 18 goes into a sheet receivable state, and then two or more sheets stacked on top of one another are discharged.

By the above-described operation, post-processing can be efficiently performed without decreasing the productivity at the time of stapling of two or more copies.

The above is just an example, and the present invention achieves effects specific to each mode described below.

(Mode 1)

In a method for attaching a pair of crimping members, such as the pair of toothed dies 261, in a sheet binding device such as the sheet post-processing apparatus 201 that binds a sheet bundle Ps by engagement of the crimping members, at least one of the crimping members, such as the upper toothed die 261*a*, is attached on a member such as the movable link member 263 on which the one of the crimping members is to be attached in a state where the pair of crimping members is in engagement.

According to mode 1, in a state where the pair of crimping members, such as the toothed dies 261, is in engagement, one of the crimping members, such as the upper toothed die 261*a*, is attached to a member such as the movable link member 263; therefore, the crimping members do not deviate from the engagement position after the attachment. Accordingly, it is possible to achieve a stable binding force.

(Mode 2)

The one of the crimping members described in mode 1 is attached by inserting a fastener member, such as the screw 263*a*, into the through-hole 263*b*, which is parallel to the direction of binding the sheet bundle, formed on the member such as the movable link member 263 on which the one of the crimping members, such as the upper toothed die 261*a*, is to be attached; a gap between the through-hole 263*b* and the fastener member is larger than a position error of the member on which the one of the crimping members is to be attached with respect to the fixed link member 264 on which the other crimping member, such as the lower toothed die 261*b*, is to be attached.

By such a configuration, as explained in the embodiment, even if the center of the through-hole 263*b* deviates from the center of the screw hole 301 of the upper toothed die 261*a* engaged with the lower toothed die 261*b* due to manufacturing errors of the movable link member 263 on which one of the crimping members, such as the upper toothed die 261*a*, is to be attached and the fixed link member 264, etc., the upper toothed die 261*a* can be fixed to the movable link member 263.

(Mode 3)

Each of the pair of crimping members such as the toothed dies 261 described in mode 1 or 2 has multiple projecting parts, such as teeth, formed to be aligned at predetermined intervals; one of the multiple projecting parts is made longer in a direction perpendicular to a direction of alignment of the projecting parts than the other projecting parts, and one of the crimping members is attached to the movable link member 263 by engaging the projecting part longer than the other projecting parts of the one of the crimping members, such as the upper toothed die 261*a*, with the projecting part longer than the other projecting parts of the other crimping member, such as the lower toothed die 261*b*.

By such a configuration, turning motion of the one of the crimping members can be suppressed by the engagement of the longer projecting parts. Accordingly, when the one of the crimping members, such as the upper toothed die 261*a*, is screwed to the member such as the movable link member 263 in a state where the pair of crimping members is in engagement, it is possible to suppress the one of the crimping members from turning in the screwing direction. Furthermore, only one of multiple projecting parts is made longer; therefore, as explained in the embodiment, it is possible to suppress a decrease in pressure, and also possible to suppress a decrease in binding force.

(Mode 4)

In a sheet binding device such as the sheet post-processing apparatus 201 that binds a sheet bundle by engagement of a pair of crimping members, the pair of crimping members is attached by any of the attachment methods according to modes 1 to 3.

By such a configuration, as explained in the embodiment, it is possible to bind a sheet bundle with a proper binding force.

(Mode 5)

In a sheet binding device such as the sheet post-processing apparatus 201 that binds a sheet bundle by engagement of a pair of crimping members, one of the crimping members is attached by inserting a fastener member, such as the screw 263*a*, into the through-hole 263*b*, which is parallel to the direction of binding the sheet bundle, formed on a member such as the movable link member 263 on which the one of the crimping members such as the upper toothed die 261*a* is to be attached; a gap between the through-hole 263*b* and the fastener member is larger than a position error of the member on which the one of the crimping members is to be attached with respect to the fixed link member 264 on which the other crimping member, such as the lower toothed die 261*b*, is to be attached.

By such a configuration, as explained in the embodiment, in a state where the pair of crimping members, such as the toothed die 261, is in engagement, the one of the crimping members, such as the upper toothed die 261*a*, can be attached on the movable link member 263.

(Mode 6)

An image forming apparatus, which forms an image on a sheet, includes the sheet binding device according to mode 4 or 5 as a binding processing means for binding sheets on which images have been formed.

By such a configuration, as explained in the embodiment, it is possible to bind a sheet bundle with a proper binding force.

According to the present invention, in a state where a pair of crimping members is in engagement, one of the crimping members is attached; therefore, the one of the crimping members is attached in a state where the pair of crimping members is properly in engagement. Accordingly, when the crimping members are engaged in a state where the crimping members have been attached to respective members, the crimping members can be uniformly engaged, and a stable binding force can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method for attaching a pair of crimping members in a sheet binding device that binds a sheet bundle by engagement of the pair of crimping members, comprising:

attaching at least one of the crimping members to a member to which the at least one crimping members is to be attached while the pair of crimping members are in engagement with one another.

2. The method according to claim 1, wherein the one of the crimping members is attached by inserting a fastener member into a through-hole formed on the member to which the one of the crimping members is to be attached, the through-hole being parallel to a direction of binding the sheet bundle, and a gap between the through-hole and the fastener member is larger than a position error of the member to which the one of the crimping members is to be attached with respect to a member to which the other crimping member is to be attached.

3. The method according to claim 1, wherein each of the crimping members has multiple projecting parts aligned at predetermined intervals, and one of the multiple projecting parts is longer in a direction perpendicular to a direction of alignment of the projecting parts than the other projecting parts, and at least one of the crimping members is attached to a member to which the one of the crimping members is to be attached by engaging the projecting part longer than the other projecting parts of the one of the crimping members with the projecting part longer than the other projecting parts of the other crimping member.

4. A sheet binding device that binds a sheet bundle by engagement of a pair of crimping members, wherein the pair of crimping members is attached by any of the methods according to claim 1.

5. A sheet binding device that binds a sheet bundle by engagement of a pair of crimping members, wherein one of the crimping members is attached by inserting a fastener member into a through-hole formed on a member to which the one of the crimping members is to be attached, the through-hole being parallel to a direction of binding the sheet bundle, and a gap between the through-hole and the fastener member is larger than a position error of the member to which the one of the crimping members is to be attached with respect to a member to which the other crimping member is to be attached.

6. An image forming apparatus that forms an image on a sheet, comprising the sheet binding device according to claim 4 as a binding processing unit for binding sheets on which images have been formed.

7. An image forming apparatus that forms an image on a sheet, comprising the sheet binding device according to claim 5 as a binding processing unit for binding sheets on which images have been formed.

* * * * *